US009314707B2

(12) United States Patent
Ornstein et al.

(10) Patent No.: US 9,314,707 B2
(45) Date of Patent: Apr. 19, 2016

(54) MAGNETIC BUILDING TILES

(71) Applicant: Box Tiles LLC, Highland Park, IL (US)

(72) Inventors: Noah J. Ornstein, Highland Park, IL (US); Joseph M. Kelley, Highland Park, IL (US)

(73) Assignee: Box Tiles LLC, Highland Park, IL (US)

( * ) Notice: Subject to any disclaimer, the term of this patent is extended or adjusted under 35 U.S.C. 154(b) by 128 days.

(21) Appl. No.: 14/022,793

(22) Filed: Sep. 10, 2013

(65) Prior Publication Data

US 2015/0072587 A1 Mar. 12, 2015

(51) Int. Cl.
*A63H 33/00* (2006.01)
*A63H 33/04* (2006.01)

(52) U.S. Cl.
CPC ..... *A63H 33/046* (2013.01)

(58) Field of Classification Search
CPC ..... A63H 3/52; A63H 33/04; A63H 33/06; A63H 33/044; A63H 33/046; A63H 33/084; A63H 33/26; G09F 1/10; G09F 7/00; G09F 7/04; G09F 15/0068; G09F 19/22; Y10T 428/24008; Y10T 428/24017; E04D 13/00; E04B 2/827
See application file for complete search history.

(56) References Cited

U.S. PATENT DOCUMENTS 2,951,311 A * 9/1960 Luther ..... 446/92
3,661,689 A * 5/1972 Spanier ..... 428/33
3,902,291 A * 9/1975 Zucht ..... 52/284
3,998,004 A * 12/1976 Ehrlich ..... 446/92
4,227,337 A * 10/1980 Murray et al. ..... 446/102
4,255,837 A 3/1981 Holtz
4,258,479 A 3/1981 Roane
4,334,870 A 6/1982 Roane
4,334,871 A 6/1982 Roane
4,561,223 A * 12/1985 Gold et al. ..... 52/202
4,884,988 A * 12/1989 McMurray ..... 446/115
5,009,625 A 4/1991 Longuet-Higgins (Continued)

FOREIGN PATENT DOCUMENTS

KR 20-0414572 4/2006
KR 10-2012-0082517 7/2012

OTHER PUBLICATIONS

Magformers XL Cruisers Construction Set, available at http://www.amazon.com/Magformers-XL-Cruisers-Construction-Set/dp/B008EGIIEM, available Apr. 23, 2013 according to archive.org/web.

(Continued)

*Primary Examiner* — Michael Dennis
*Assistant Examiner* — Urszula M Cegielnik
(74) *Attorney, Agent, or Firm* — Fitch, Even, Tabin & Flannery LLP

(57) ABSTRACT

A building system includes a plurality of building tiles and/or connecters that are magnetically and releasably connectable to one another. The magnetic building tiles are comprised of a tile frame and a tile panel. The tile frame, by one approach, is comprised of two connectable frame portions or elements having magnets embedded therein. The first frame element and the second frame element are connectable to one another through a snap, clip, or another similar connection mechanism. The first and second frame elements are connectable around or into the tile panel, which is removable from the magnetic building tile. The tile panel or the tile frame has a channel into which the other of the tile panel or tile frame extends to secure the two pieces together.

14 Claims, 25 Drawing Sheets

(56) References Cited

U.S. PATENT DOCUMENTS

| | | | | |
|---|---|---|---|---|
| 5,134,812 | A | 8/1992 | Hoffman et al. | |
| 5,161,827 | A * | 11/1992 | Grosso | 283/77 |
| 5,830,032 | A | 11/1998 | Campbell | |
| 5,888,114 | A * | 3/1999 | Slocum et al. | 446/128 |
| 6,298,591 | B1 * | 10/2001 | Healy | 40/600 |
| 6,500,007 | B2 * | 12/2002 | Pupulin | 434/171 |
| 6,824,440 | B2 * | 11/2004 | Brener | 446/124 |
| 6,969,294 | B2 | 11/2005 | Vicentelli | |
| 7,066,778 | B2 | 6/2006 | Kretzschmar | |
| 7,273,404 | B2 * | 9/2007 | Kowalski et al. | 446/92 |
| 7,373,748 | B2 * | 5/2008 | Pitcher et al. | 40/658 |
| 7,520,080 | B2 * | 4/2009 | Pitcher et al. | 40/658 |
| 7,559,821 | B2 | 7/2009 | Pacheco | |
| 7,743,541 | B2 * | 6/2010 | Suciu et al. | 40/658 |
| 7,833,078 | B2 | 11/2010 | Kretzschmar | |
| 7,922,417 | B2 * | 4/2011 | Jimenez | 403/364 |
| 8,850,683 | B2 * | 10/2014 | Haughey et al. | 29/428 |
| 8,875,427 | B2 * | 11/2014 | Valiulis | 40/600 |
| 8,904,688 | B1 * | 12/2014 | Rue et al. | 40/711 |
| 2001/0004817 | A1 * | 6/2001 | Auer | 52/238.1 |
| 2002/0193046 | A1 * | 12/2002 | Zebersky | 446/476 |
| 2005/0241197 | A1 * | 11/2005 | Ternovits et al. | 40/600 |
| 2006/0166590 | A1 | 7/2006 | Ishikawa | |
| 2009/0013576 | A1 * | 1/2009 | Jake et al. | 40/725 |
| 2009/0217560 | A1 * | 9/2009 | Topcuoglu | 40/600 |
| 2010/0251659 | A1 * | 10/2010 | Hughes | 52/646 |
| 2011/0039473 | A1 | 2/2011 | Kretzschmar | |
| 2013/0072086 | A1 | 3/2013 | Saneshige | |
| 2013/0095722 | A1 * | 4/2013 | Cochella | 446/85 |
| 2014/0227934 | A1 * | 8/2014 | Rudisill | 446/92 |

OTHER PUBLICATIONS

International Search Report mailed Jan. 7, 2015 for PCT/US2014/054902.

* cited by examiner

MAGNETIC BUILDING TILES

TECHNICAL FIELD

This disclosure relates generally to toy building elements.

BACKGROUND

Kits to create models of buildings, vehicles, and other structures are popular with children, parents, and hobbyists. Such kits may engage and encourage a child's imagination. One type of kit provides a model or replica of a specific larger structure such as, e.g., a castle or a log cabin. Another type of kit includes pieces that may be used to build a variety of different structures.

Kits that create impressive and realistic replicas of specific structures may limit or inhibit a child's creative play by their inherent design. For example, the materials in such kits are typically printed and/or shaped to correspond closely to the original structure (or a child's typical interpretation of such a structure) such that these materials are not easily repurposed or reconfigured into other structural elements. In addition, many of these kits do not provide an easily changeable, customizable, or adjustable structure.

Kits that can easily be used to create a variety of structures include building elements that can be repurposed or reimagined. These kits, however, do not necessarily allow the user the ability to customize the building elements to help the structure resemble another known structure, or even just to personalize the buildings or structures created, which also may limit imaginative play. For example, some building sets have pieces with only a small number of shapes and colors. Further, the colors of the individual pieces are somewhat arbitrary and the pieces are not typically designed to coordinate or replicate known structures or provide children the opportunity to develop imagined structures. Moreover, the individual pieces are not readily alterable or customizable by children.

SUMMARY

A toy building kit or system comprised of magnetic building tiles is provided. The magnetic building tiles are magnetically connectable with one another and are comprised of a frame and a removable panel or insert. The frame, by one approach, is comprised of at least two connectable portions or elements having magnets embedded therein. The frame elements may be connectable to one another through one or more snaps, clips, or other connection mechanisms.

By one approach, the tile panel has a channel around its edge in which the first and second frame elements, or portions thereof, are received to secure the panel relative to the frame. In another approach, the first and second frame elements are designed to extend externally around an edge of the tile panel, rather than being wholly or partially within a channel of the panel. In such a configuration, the frame elements may have channels in which edges of the panels are received.

In one configuration, the tile panel and frame generally form a square when viewed from the front. In other configurations, the building tiles may form triangular, rectangular, oval or other shapes.

To provide a user with the ability to customize the kit, the kit may permit the user to easily insert and remove the panels from the frames such that the panels are interchangeable. In this manner, a user can color, paint, or otherwise decorate the panels, which may be connected to one another to build a structure, such as a play house, teepee, theater, castle, car, boat, farm stand, kitchen, elephant, floor puzzle, or mural, to note a few of the endless options. Further, once a user is finished with the design of a particular panel, it can be easily removed from the frame and replaced with a different panel. Also, pre-decorated or designed panels may be used with the frames. For example, to enable a user to build a model of a brick house, tile panels with a brick motif may be inserted into the tile frames. The panels may be comprised of one or more materials such as cardboard, paperboard, composite materials, plastic, metals or other light and rigid materials safe for handling by children.

The kit may include magnetic and/or magnetic and mechanical connectors. In one illustrative embodiment, the magnetic, mechanical connector (hereinafter referred to as a "mechanical connector") includes a frame element with magnets disposed therein, a pair of extension elements extending from the frame element in a substantially parallel arrangement, and a pair of wings flexibly connected to the pair of extension elements, arranged between the extension elements, extending from distal edges of the extension elements toward the frame element. By one approach, a plurality of friction elements is disposed on the pair of wing surfaces facing one another such that the friction elements may engage and securely attach the mechanical connector to a sheet of material such as a cardboard cutout. The mechanical connector may have a hinge disposed between the extension elements and the frame element to provide for relative movement, e.g., pivoting of the two pieces. In another configuration, the mechanical connector includes a frame element with a rounded face such that the frame element has a nearly semi-circular configuration. The rounded face of the frame element permits the entire mechanical connector to be rotated on the rounded face of the frame element. A mechanical connector with a hinge or rounded face can be used together with another connector or tile to provide for a portion of a structure that moves relative to another portion of the structure. For example, to enable a user to build a structure with structural elements that move relative to one another, such as a model of a house with a door, or an animal with a sweeping tail, or a fort with a drawbridge, one or more mechanical connector elements with hinges may be employed.

Elements in the figures are illustrated for simplicity and clarity and have not necessarily been drawn to scale. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
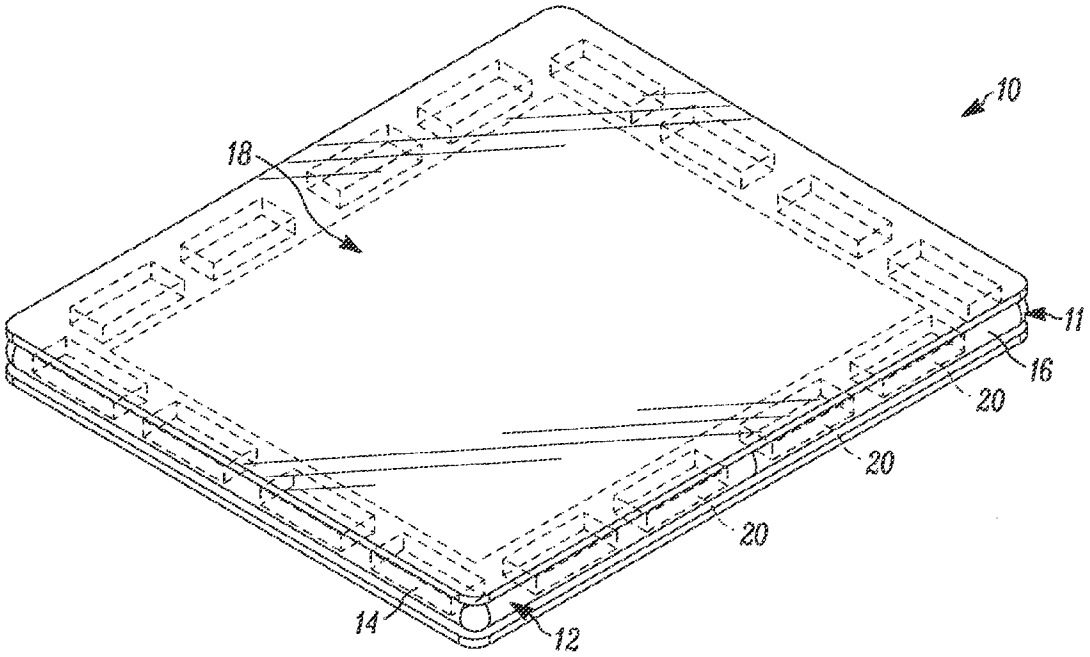
FIG. 1 is a perspective view of a magnetic building tile.
Figure 31:
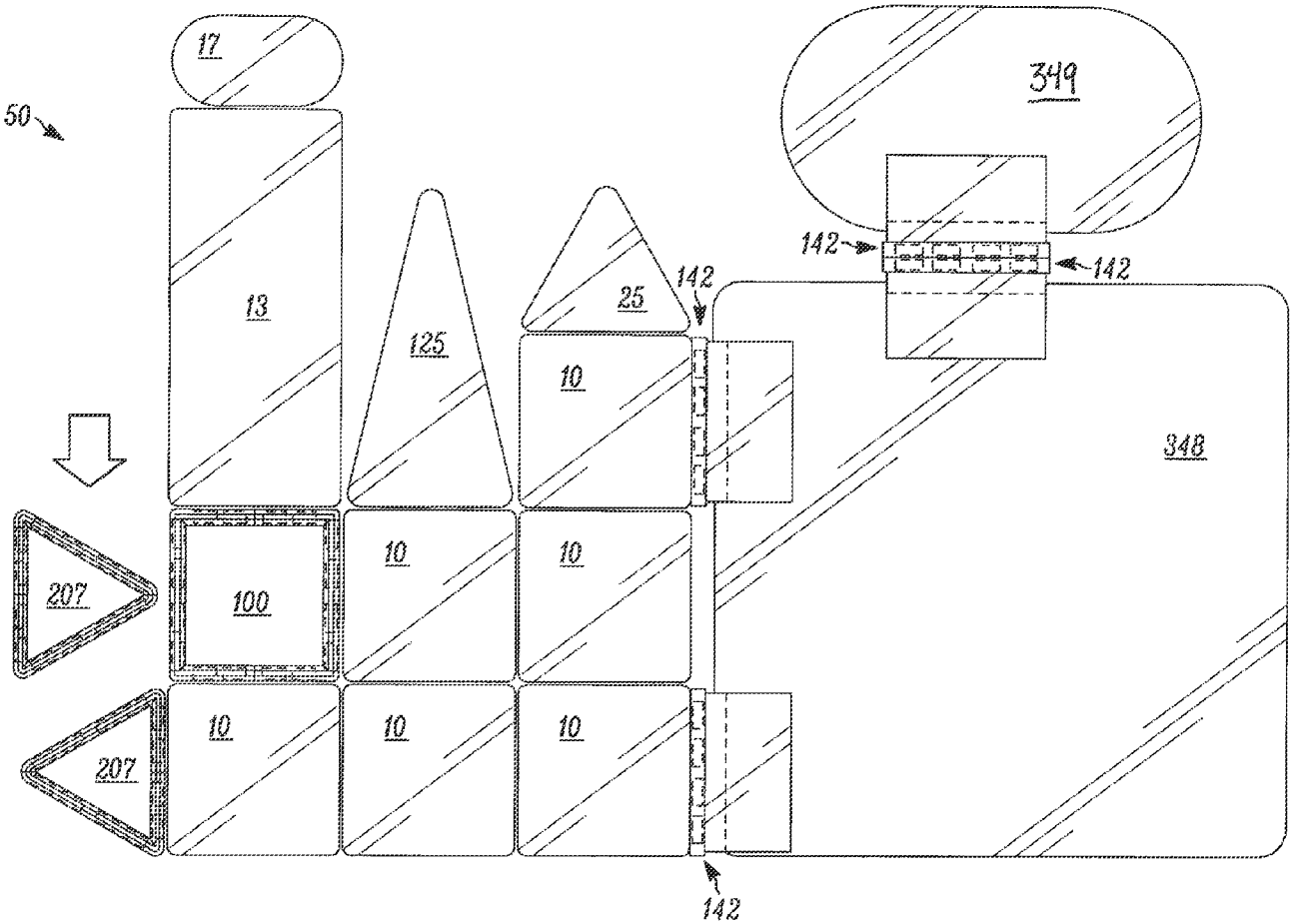
FIG. 31 is a front view illustrating connected magnetic building tiles, mechanical connectors, and cardboard cutouts.
Figure 32:
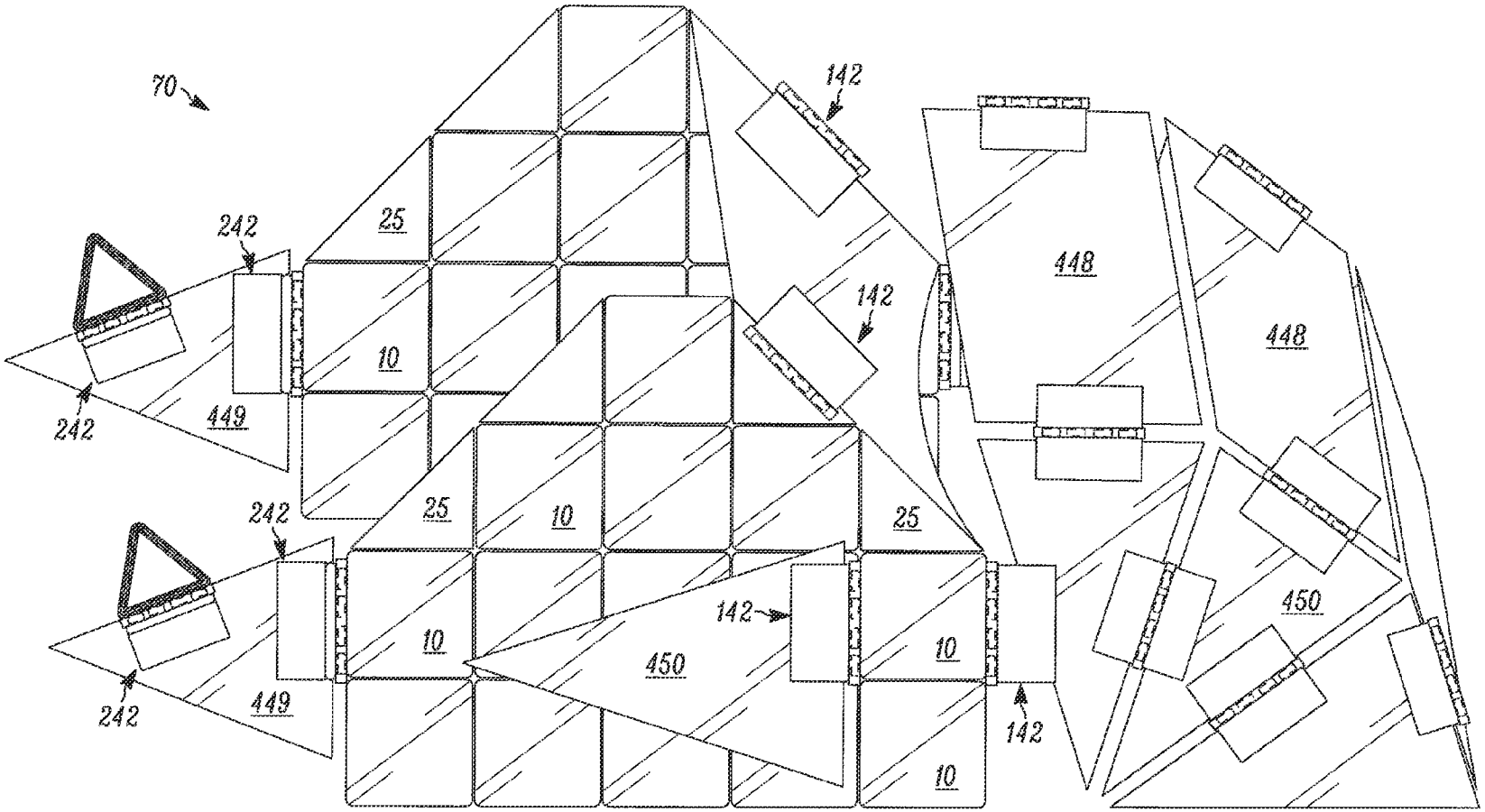
FIG. 32 is a top perspective view illustrating connected magnetic building tiles, mechanical connectors, and cardboard cutouts.
Figure 33:
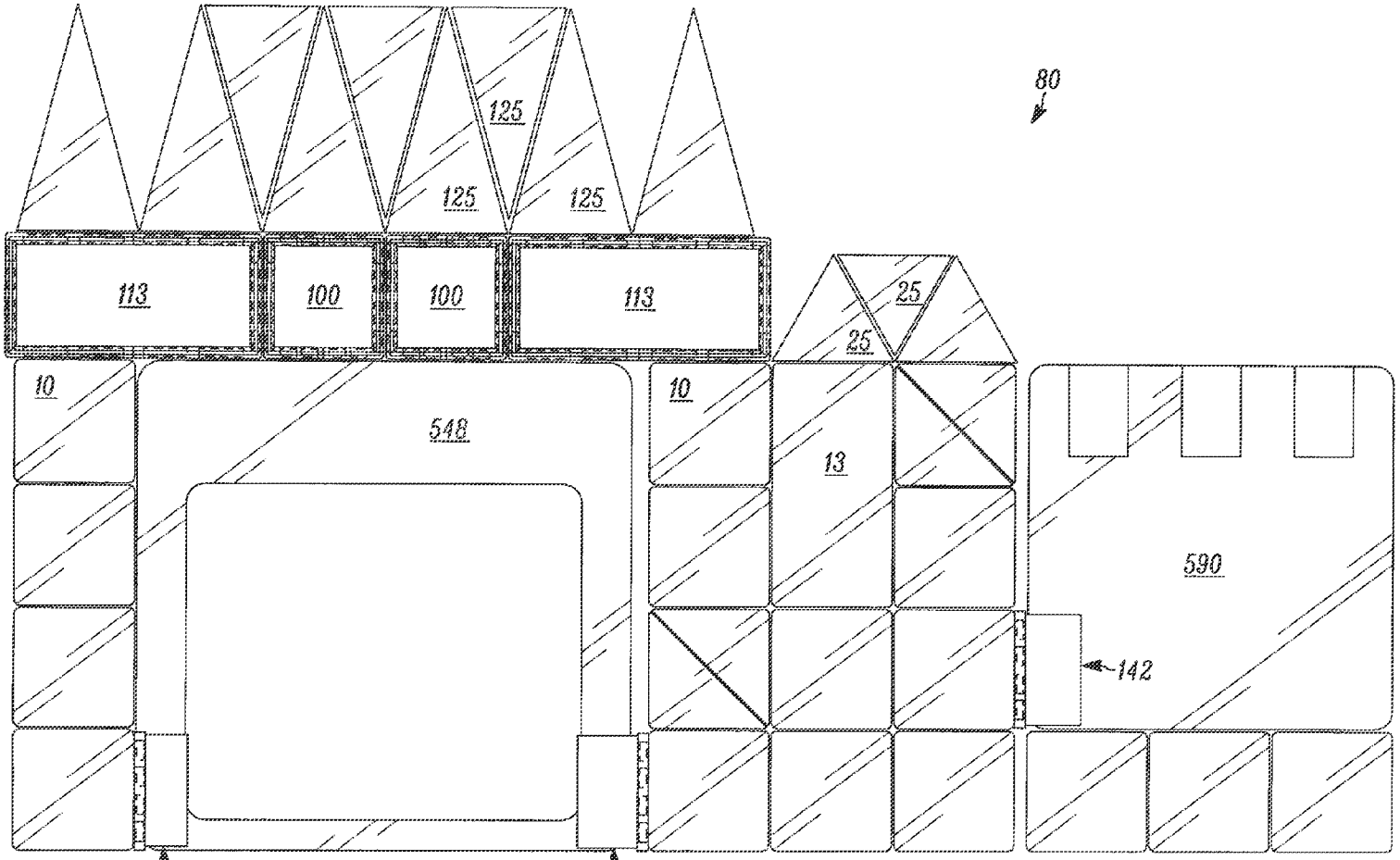
FIG. 33 is a front view illustrating connected magnetic building tiles, mechanical connectors, and cardboard cutouts.

FIG. 1 illustrates a single building tile 10 that is magnetically connectable to other building tiles. For example, a side edge 11 of the building tile 10 may be magnetically connected to a side edge 11 of an adjacent building tile 10 (see, e.g., FIGS. 31 and 36), or to the front of an adjacent building tile 10 (see, e.g., FIG. 37), such that the building tiles 10 require a predetermined force to separate the magnetically connected building tiles 10. FIGS. 31-33 illustrate a set or a portion of a set 50, 70, 80 of building tiles 10 and other tile configurations and building elements described below. The sets or kits 50, 70, 80 described herein are illustrative and a variety of magnetic tiles, magnetic connectors, mechanical connectors, and cardboard pieces, cutouts, or boxes may be employed therewith.

Figure 4:
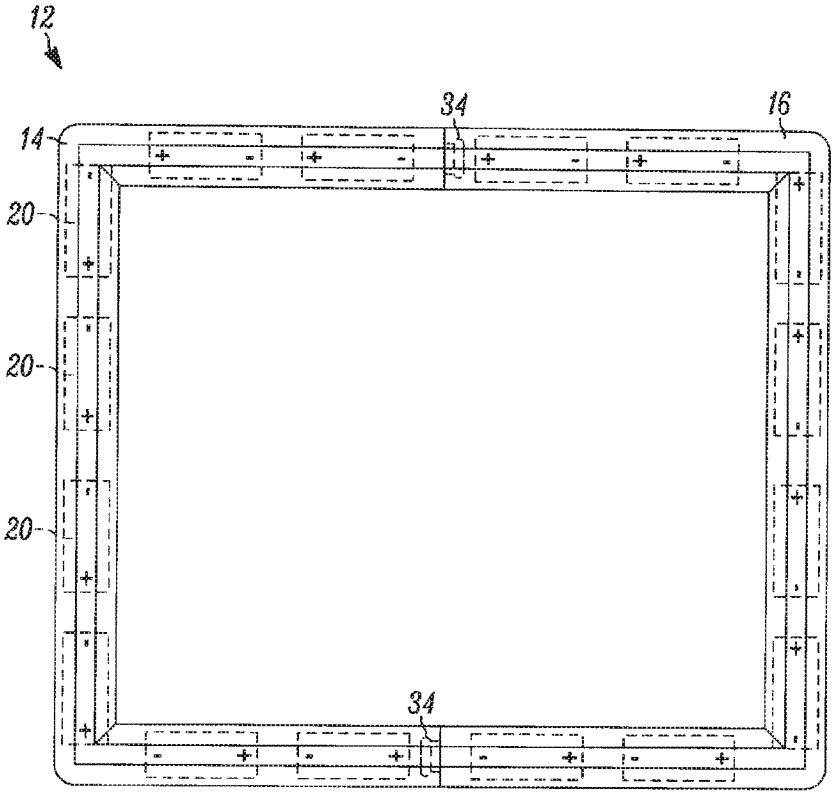
FIG. 4 is a front view of a closed frame of the magnetic building tile of FIG. 1.

As shown, a tile frame 12 and a tile panel 18 are configured to mate together to form the building tile 10. By one approach, the tile frame 12 has a first frame portion 14 that releasably connects with a second frame portion 16. In other configurations, the tile frame 12 may be comprised of more than two portions or may be a single unitary configuration. Each of the frame portions 14, 16 may have magnets 20 disposed therein. FIG. 4 illustrates one exemplary arrangement of the magnetic poles of the magnets 20. A variety of magnets including a variety of types, shapes, and sizes may be employed in the frame 12. In one configuration, the tile frame includes a plurality of square or rectangular shaped magnets, though other shapes also may be included.

Further, the frame 12 may include only a few magnets or, alternatively, may include many magnets, and this may depend, in part, on the type, shape, strength, and size of the magnets used. By one approach, each side of the magnetic building tile 10 with a similar length includes the same number of magnets 20. Thus, the magnets are generally evenly distributed through the length of the frame.

In one configuration, the magnets 20 are injection molded into the plastic frame 12 such that the magnets are secured within the structure of the frame 12. Other alternative arrangements are possible. For example, the magnets 20 may be snap fit into the frame or glued into the frame, to note but two additional options.

Once assembled, the building tiles may have a height and width of between about 2 to about 50 centimeters, though other dimensions are possible. In one illustrative embodiment, the building tiles may have a height of between about 7 to about 40 centimeters and width of between about 7 to about 40 centimeters. Further, an assembled building tile may have a thickness of between about 0.25 to about 2.0 centimeters. In one illustrative embodiment, an assembled building tile has a thickness of about 0.5 to about 1 centimeter, though other thickness may be employed.

As mentioned above, the frame 12 may have a first and second frame portion 14, 16 that are connectable to one another around at least portions of the panel 18 such that the frame 12 is securely mated to the tile panel 18, as shown in FIG. 1. To secure the first and second frame portions 14, 16 together, the frame 12 may include a frame connection mechanism 22 that permits a user to releasably connect the frame portions 14, 16 together. By one approach, the first and second frame portions 14, 16 are snap fit together. For example, the frame connection mechanism 22 may include a cantilever beam snap fit, a cylindrical snap fit, or a spherical snap fit. In one configuration, the snap fit connection is magnetic, such that the first and second frame portions 14, 16 have a magnetic snap fit. Such a releasable connection permits the frame 12 to be releasably connected to the tile panel 18, which is then removable and interchangeable. When a user wants to remove the panel 18 from the building tile 10, the user pulls the portions of the frame 14, 16 away from one another such that the two portions disengage with one another. In this manner, the tile panel 18 may then be removed from the tile frame 12.

Figure 2:
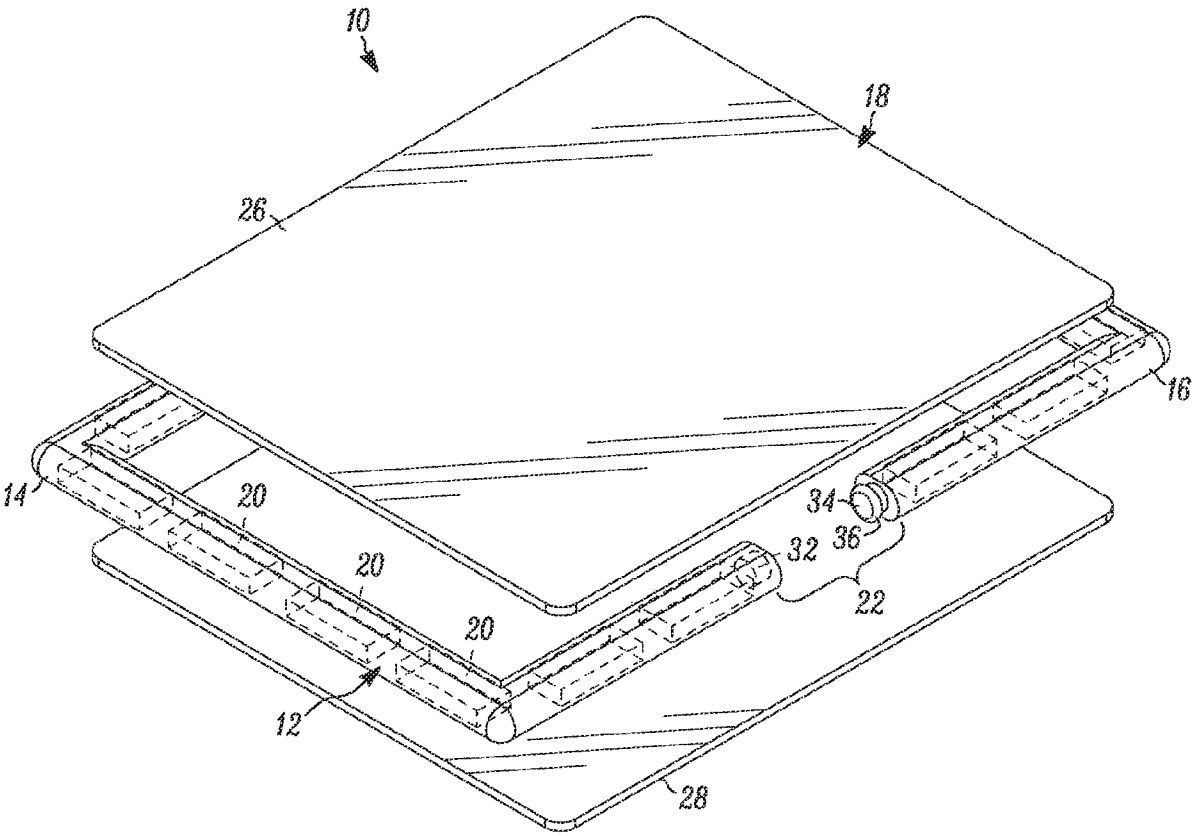
FIG. 2 is an exploded view of the magnetic building tile of FIG. 1.
Figure 3:
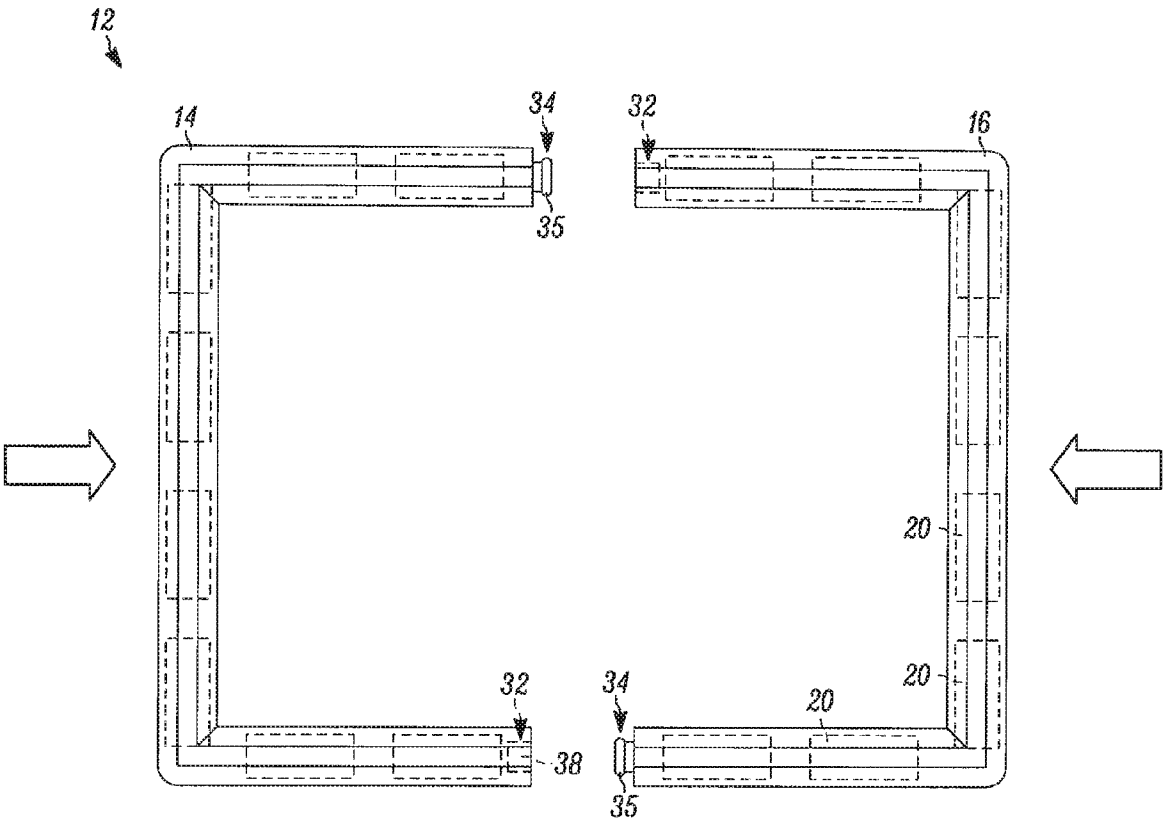
FIG. 3 is a front view of an open frame of the magnetic building tile of FIG. 1.
Figure 5:
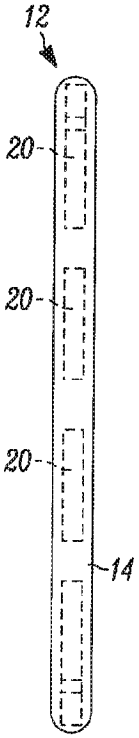
FIG. 5 is a side view of a closed frame of the magnetic building tile of FIG. 1.

As shown in FIGS. 2 and 3, the connection mechanism 22 may include a first joint portion 32 and a second joint portion 34 that mate together. The first and second portions 32, 34 are disposed at ends of the first and second frame portions 14, 16 where the frame portions 14, 16 meet together when disposed around portions of the tile panel 18. The connection mechanism 22 of FIG. 2 is a mechanical joint between the first and second frame portions 14, 16. The flexible locking feature of the connection mechanism 22 includes a catch 35 of the second portion 34 and a recess 38 that mates with the second portion 34. FIG. 3 illustrates how the first and second frame portions 14, 16 may be pushed together to secure the frame portions together via the connection mechanism 22. FIG. 4 illustrates how the connected frame 12 will appear, without the tile panel 18. To separate the first and second frame portions 14, 16, the user will pull the frame portions apart in a direction opposite to that illustrated in FIG. 3.

Figure 7:
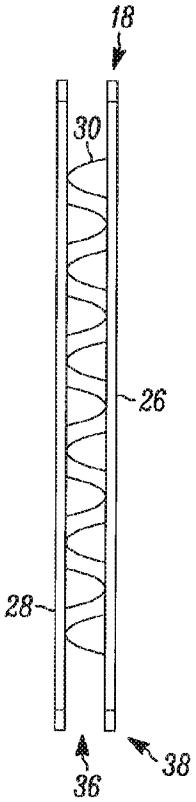
FIGS. 6-7 are front and side views of a panel in accordance with one embodiment.
Figure 6:
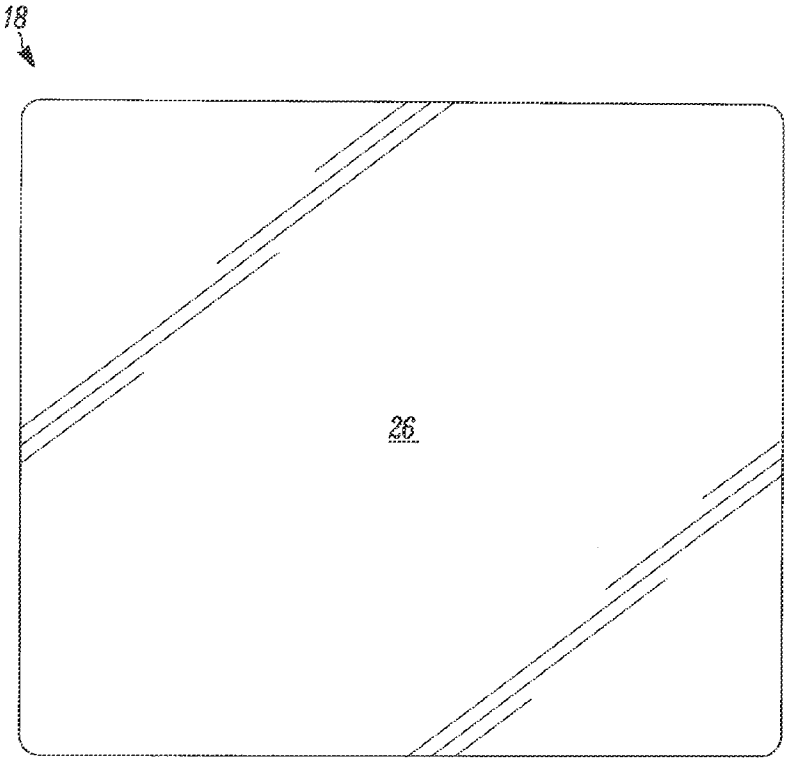

The tile panel 18, shown in FIGS. 6 and 7, has a first and a second tile wall 26, 28. In between the two panel walls 26, 28, the tile panel 18 has a core or connecting member 30 (see, e.g., FIG. 7) that may take a variety of configurations. In one approach, the connecting member 30 is a wavy sheet of material, similar to the material found inside of corrugated cardboard or paperboard. In other configurations, the connecting member may be foam or a block of material attached to both panel walls 26, 28. In yet other configurations, the connecting member 30 may be another structure capable of keeping the first and second tile walls 26, 28 secured relative to one another.

Figure 9:
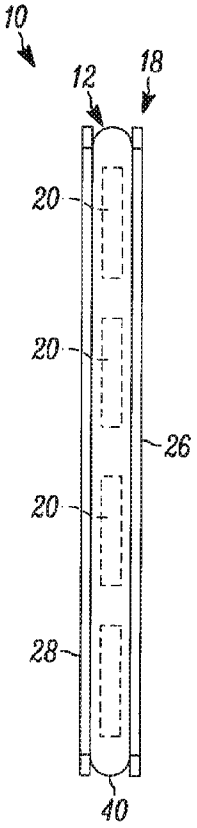
FIG. 9 is a side view of the frame and panel of FIG. 8.
Figure 8:
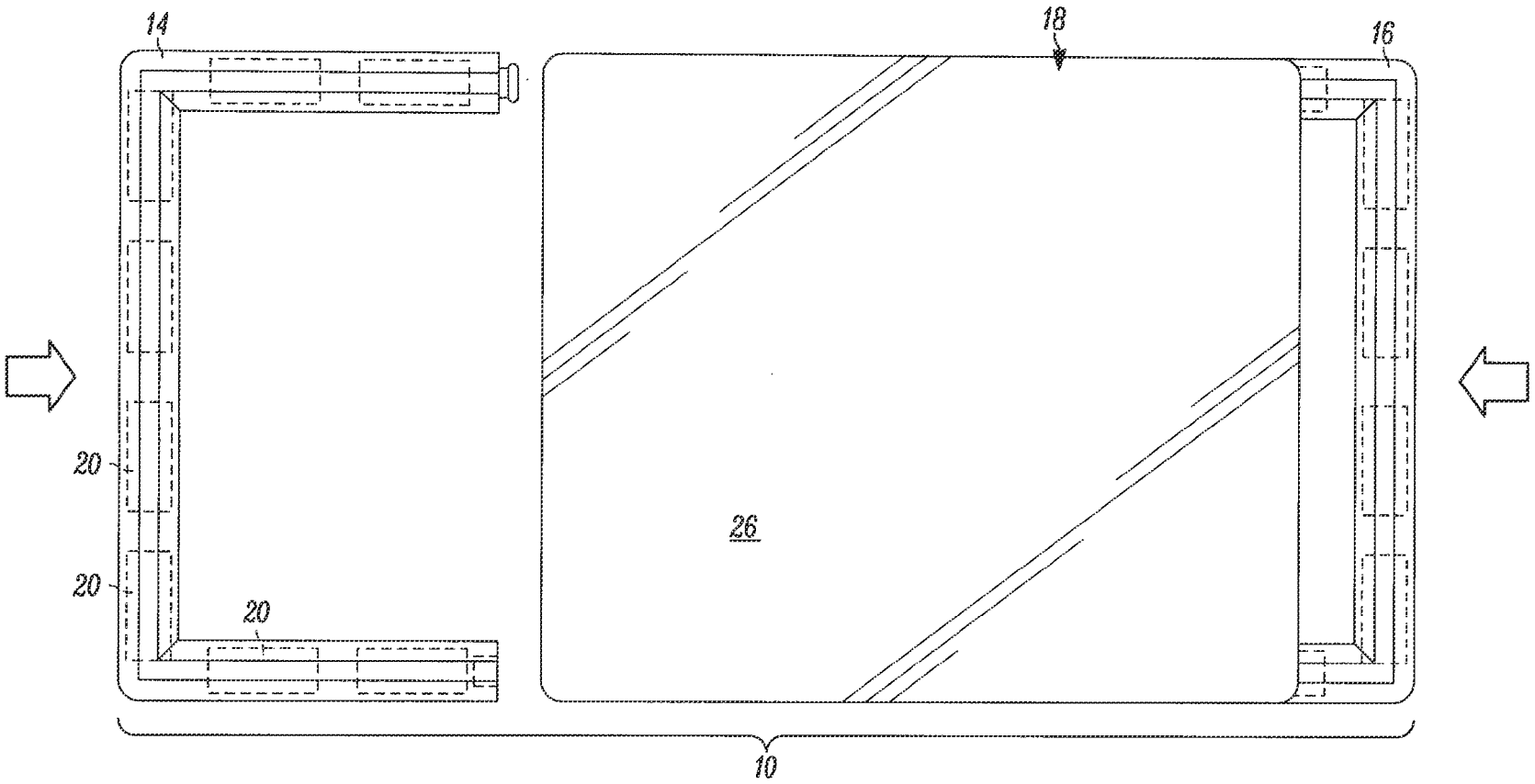
FIG. 8 is a front view of a frame being connected around the panel of FIGS. 6 and 7.

FIG. 7 also illustrates a panel channel 36 formed adjacent a panel edge 38 of the tile panel 18. In one illustrative embodiment, the panel channel 36 extends around the entire edge of the tile panel 18. The tile frame 12 may extend within the channel 36, and the first and second frame portions 14, 16 may snap together within the panel channel 36 to form the building tile 10. In one configuration, the panel channel 36 is deep enough such that a frame edge 40 is disposed near the panel edge 38. In this manner the magnets 20 are disposed relatively near the side edge 11 of the building tiles 10 to permit adjacent building tiles 10 to magnetically connect with one another. Further, having the frame edge 40 disposed near the panel edge 38 allows a user to manually grasp the frame 12 to pull apart the frame portions 14, 16 and push the frame portions 14, 16 together (see, e.g., FIG. 8). FIG. 9 illustrates a side view of the building tile 10 with the tile frame 12 mated together with the tile panel 18.

Figure 37:
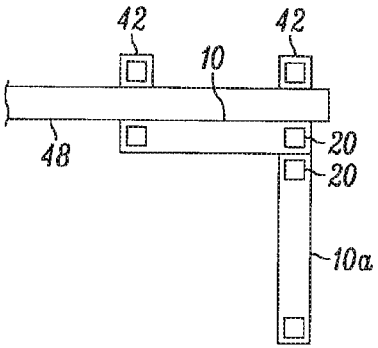
FIG. 37 is a cross section of an alternative connection between the two magnetic building tiles in FIG. 36.
Figure 36:
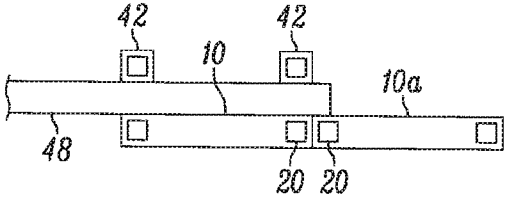
FIG. 36 is a cross section of a portion of FIG. 20 illustrating the connection between two magnetic building tiles.
Figure 38:
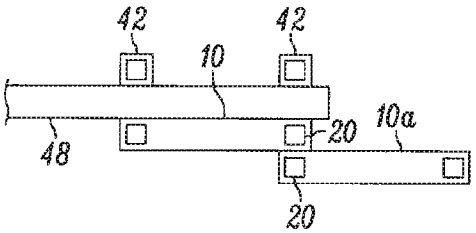
FIG. 38 is a cross section of an alternative connection between the two magnetic building tiles in FIG. 36.

When magnetically connecting the tiles together, adjacent tiles may connect in an edge-to-edge connection (FIG. 36), an edge-to-face connection (FIG. 37), or a face-to-face connection (FIG. 38). In each of these connection configurations, the portions of the building tiles that connect to one another are proximate to the frame, which has the magnets disposed therein. As shown in FIG. 36 (which illustrates a cross section of a portion of FIG. 20), two tiles that connect edge-to-edge generally have an edge abutting the other tile. Though the tiles 10 and 10*a* are illustrated as disposed 180° from one another, other configurations and angles are anticipated. By one approach, the edges of the tiles are rounded. In the edge-to-face configuration, shown in FIG. 37, one tile may be disposed at any angle from the other tile (tiles 10 and 10*a* are illustrated at a 90° configuration for merely illustrative purposes) and the edge of one tile 10*a* is disposed adjacent the face of another tile 10 at or near the location of the magnets. As suggested above, if an edge-to-face connection is desired with a non-perpendicular configuration, a user may orient the tiles in such a configuration. In another configuration, shown in FIG. 38, a face-to-face connection is arranged by disposing the faces of two tiles, at or near the location of the magnets, adjacent to one another. Any of these connections may be employed when configuring the tiles into structures, and the preferred connection may depend on the desired structure.

Figure 11A:
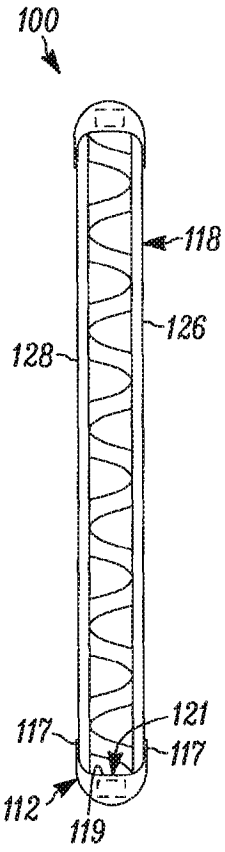
FIG. 11A is a cross sectional view of the tile of FIG. 10 with a frame.
Figure 10:
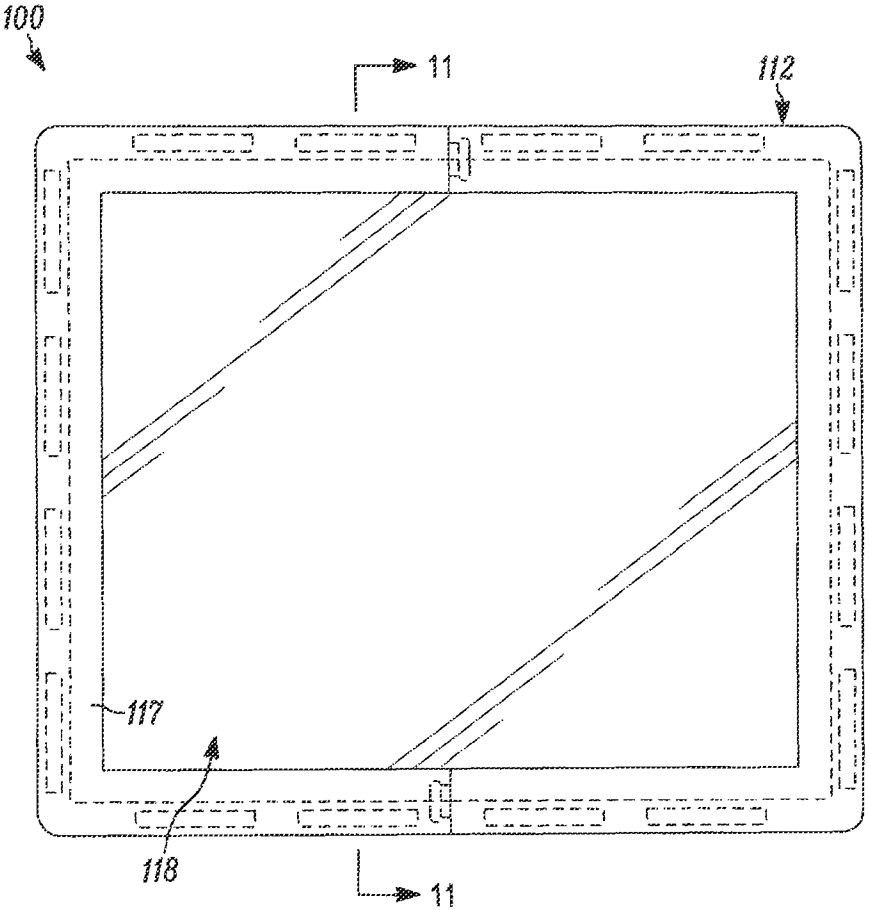
FIG. 10 is a front view of a tile in accordance with another embodiment.
Figure 11C:
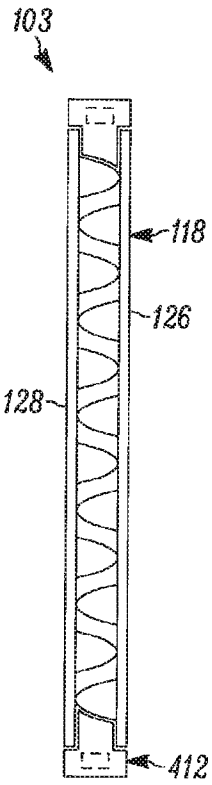
FIGS. 11B-C are cross sectional views of tiles in accordance with additional embodiments.
Figure 11B:
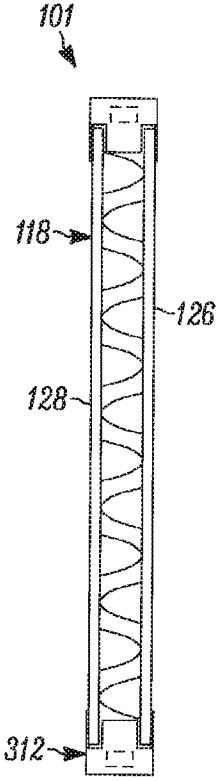

FIGS. 10 and 11A illustrate an alternative building tile 100. The building tile 100 is similar to the building tile 10 discussed above, except the tile frame 112 is generally disposed around and outside the edge of the tile panel 118, as opposed to within a channel 38 of the tile panel 18. FIG. 11B illustrates a building tile 101 that incorporates both a frame disposed around the edge of the panel and within the channel and FIG. 11C illustrates a frame disposed within the channel and along the edge of the panel. As shown in FIGS. 11A-C, the tile panel 118 does not necessarily have the same channel as described above with respect to panel 18. In yet another embodiment, shown in FIG. 43, a single type of frame 712 may cooperate with a number of different panels 718*a*, 718*b*, 718*c*. Further, for some panels, such as panel 718*c*, the frame 712 and panel 718 can be engaged in more than one engaged configuration.

Figure 41:
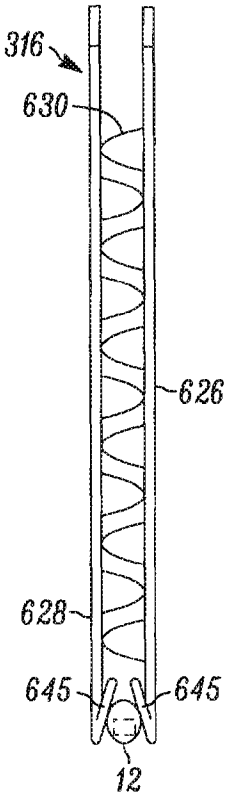
FIG. 41 is a cross-sectional view of the panel of FIG. 40 with another frame engaged therewith.
Figure 40:
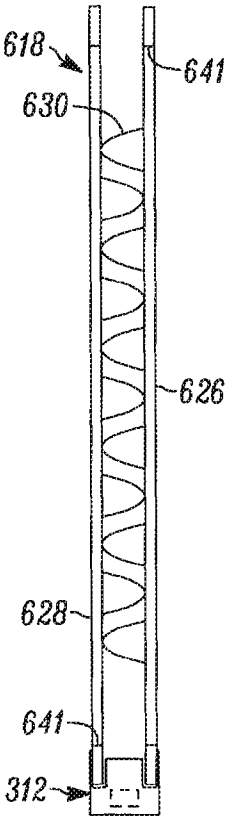
FIG. 40 is a cross-sectional view of the panel of FIG. 39 with a frame engaged therewith.
Figure 39:
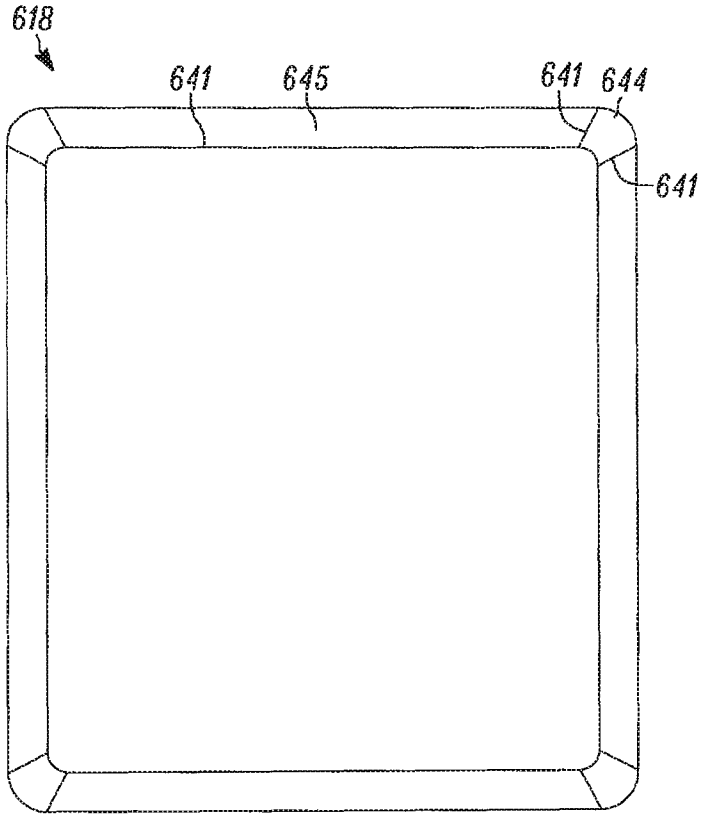
FIG. 39 is a front view of an alternative panel.

FIG. 10 illustrates a panel 118 having a panel perimeter or edge 119 disposed within the frame 112. In one embodiment, the frame 112 includes a pair of arms 117 that each extend on either side of the panel 118, as shown in the illustrative embodiment of FIG. 11A. Further, the tile frame 112 has a channel 121 into which an edge of the tile panel 118 is secured. In this configuration, the tile frame 112 is disposed around the edge of the tile panel 118 and the frame 112 generally does not extend in between the two panel walls 126, 128. Another embodiment, shown in FIG. 11B, includes a building tile 101 having a tile frame 312 that is disposed around the edges of the panel 118 and is partially disposed in between the two panel walls 126, 128. Such a configuration may be desirable to ensure a very secure fit between the tile panel 118 and the tile frame 312. In yet another configuration, the building tile 103 has a tile frame 412 that extends in between the walls 126, 128 of the panel 118 and along the edge of the panel, but not along the outside surfaces of the walls 126, 128. The embodiment illustrated in FIG. 11C is similar to the embodiment of FIG. 1, though in FIG. 11C the frame 412 extends outwardly from the perimeter of the panel 118 and covers the end surfaces of the side walls 126, 128 such that the magnets are disposed outwardly of the panel perimeter as well. As discussed above, the panels may have a channel into which the frame extends (see, e.g., FIGS. 7-9) and/or the frame may have a channel into which a panel can extend (see, e.g., FIGS. 10-11C). Though the panel 118 may be engaged by three different frames 112, 312, 412, it may be desirable to have a panel that also can be engaged by the frame 12 illustrated in FIG. 3. FIGS. 39-41 illustrate a convertible tile panel 618 that is adjustable for use with any of the tile frame configurations described herein.

Figure 42:
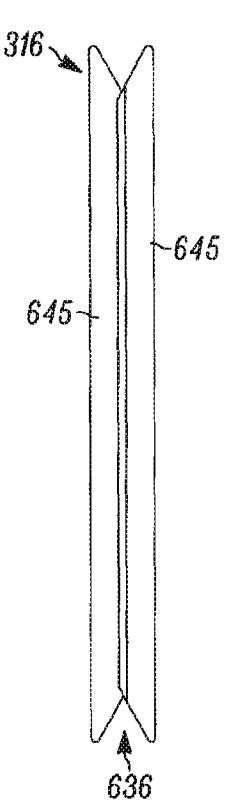
FIG. 42 is a side view of the panel of FIG. 39 without a tile frame.

In one approach, the convertible tile panel 618 has two panel walls 626, 628 with a connecting member 630 therebetween and a crease, score, or line of weakness 641 on the walls 626, 628 disposed proximate the edge of the walls. This line of weakness 641 permits the panel 618 to be folded or bent into another configuration. For example, a margin 645 of the panel 618, which is disposed outside of the line of weakness 641, can be manipulated or folded in between the two panel walls 626, 628 as shown in FIG. 42. To assist with the manipulation of the tile panel 618, in one exemplary embodiment, the tile panel 618 may include corner portions 644 that can be removed from the remainder of the panel 618 to facilitate configuration of the remainder of the panel 618 into the folded configuration. Further, it is possible that the margins 645 also may be removed from the panel 618 prior to use with any of the frames described herein.

FIG. 40 illustrates an unfolded convertible panel 618 having one end of the panel 618 engaged with a tile frame 312. In this configuration, the tile panel 618 remains unfolded. Alternatively, a portion of the tile panel 618 beyond the line of weakness 641 may be folded over, as shown in FIGS. 41 and 42. In this manner, the tile panel 618 can receive a tile frame 12 in the channel 636 formed in between the two portions or margins 645 that are folded in between the panel walls 626, 628. It is also anticipated that the margin 645 might be entirely removed from the panel 618, depending on the design of the frame that is to be disposed within the channel 636.

Figure 43:
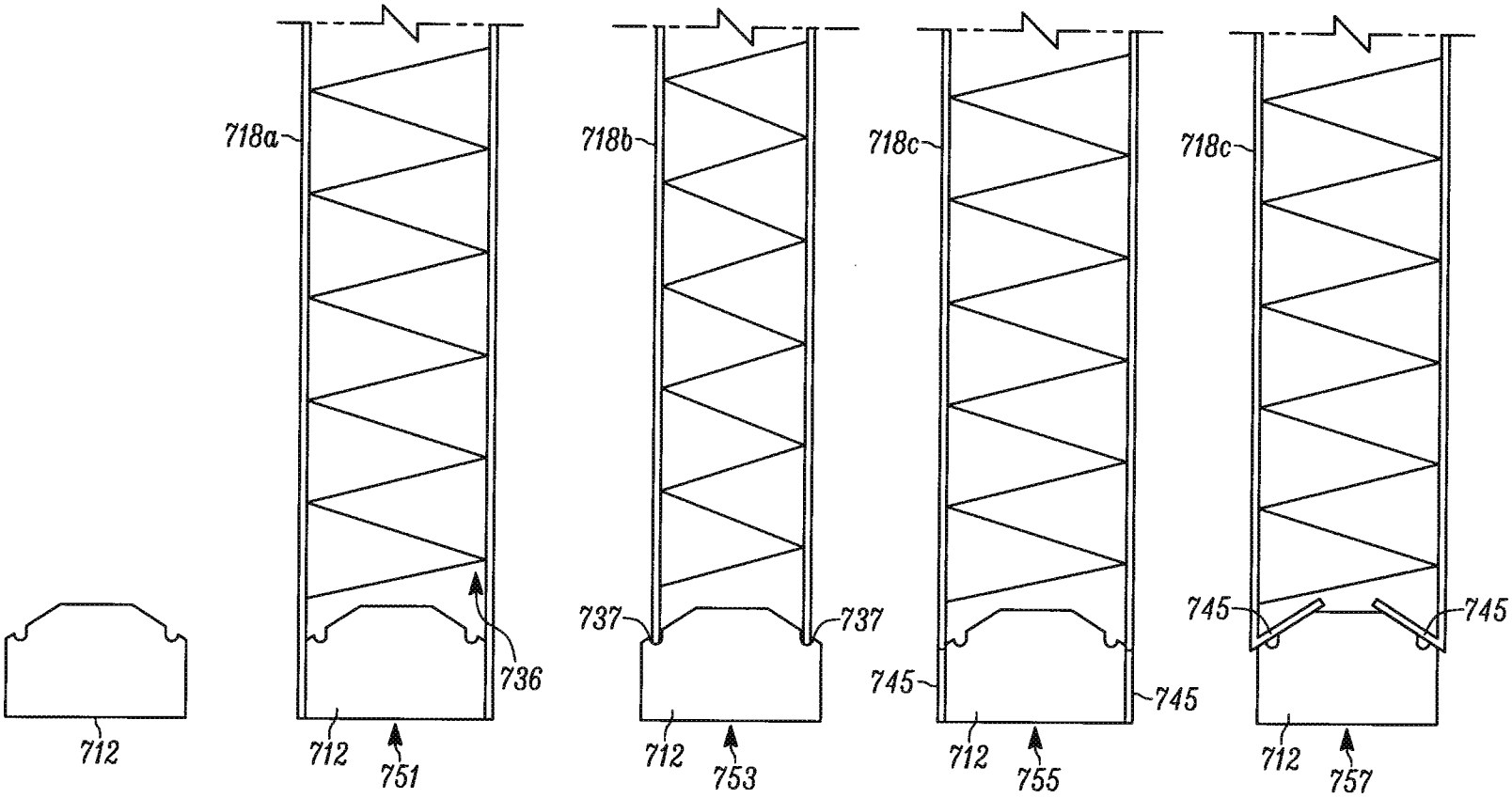
FIG. 43 is a schematic cross-sectional view of a frame engaging different panels.

In one exemplary embodiment, illustrated in FIG. 43, a tile frame 712 may be engaged with a number of different panels. The building tile configuration of 751 (which is similar to the building tile 10 shown in FIG. 1) includes frame 712 that is disposed in a channel 736 of panel 718*a*. The building tile configuration of 753 has panel 718*b* engaging channels 737 disposed in frame 712. As illustrated in FIG. 43, the panels 718*a*, 718*b*, though similar, have different widths. The building tile configurations 755 and 757 include a convertible panel 718*e*, similar to panel 618 discussed above, and illustrate how the frame 712 and the panel 718*c* can be used in two different arrangements. The building tile configuration 755 has the frame 712 disposed within the margins 745 of the convertible panel 718*c*, whereas in building tile configuration 757, the panel margins 745 are folded inward and the frame 712 engages the margins 745 disposed in the channel 736.

FIGS. 1-11 depict building tiles 10, 100 with a generally square configuration when viewed from the front. As shown in FIG. 31, additional configurations include a rectangular-shaped building tile 13, triangular-shaped building tiles 25, 125, and oval-shaped building tile 17, among others. Indeed, the shapes illustrated are merely exemplary and many other shapes and configurations are possible within the scope of these teachings. A variety of shapes can be employed with building tiles, e.g., building tiles 10, having a channel in the tile panel or with building tiles, e.g., building tiles 100, having a channel in the tile frame. Further, the variety of shapes (rectangular, triangular, oval, circular, etc.) and configurations (channels on the tile panel and/or channels on the tile frame) may be used together to form a myriad of building structures.

Figure 12:
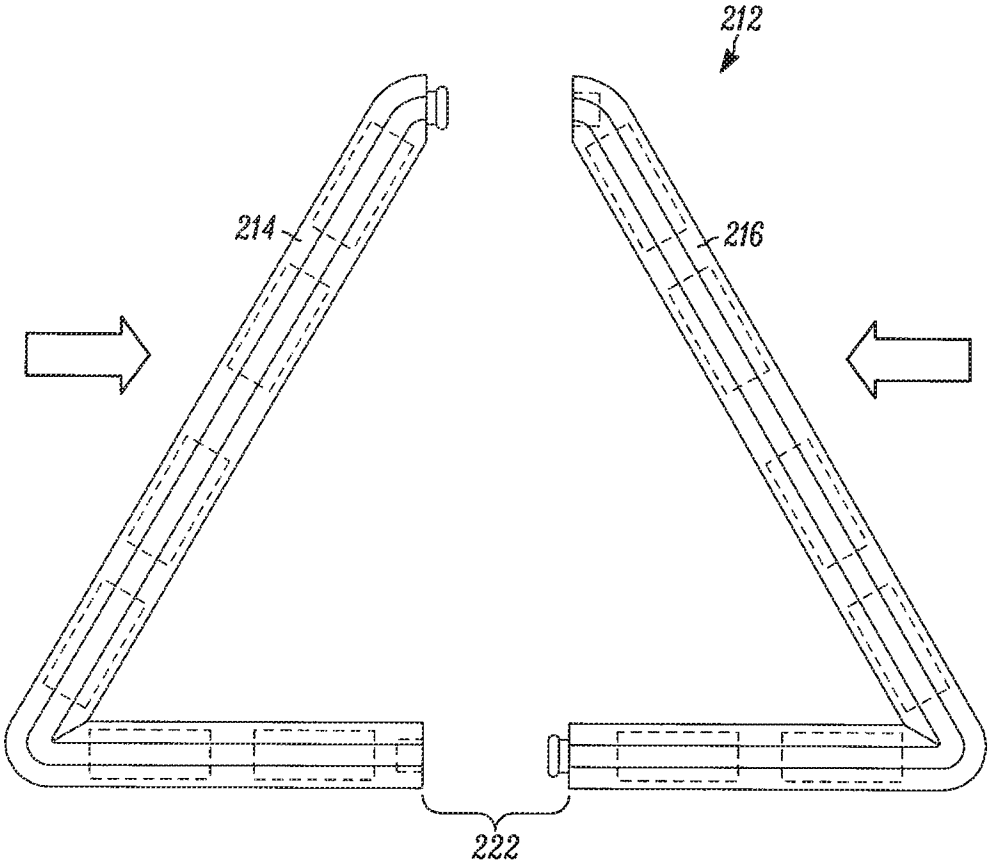
FIGS. 12-13 illustrate a frame in accordance with another embodiment.
Figure 13:
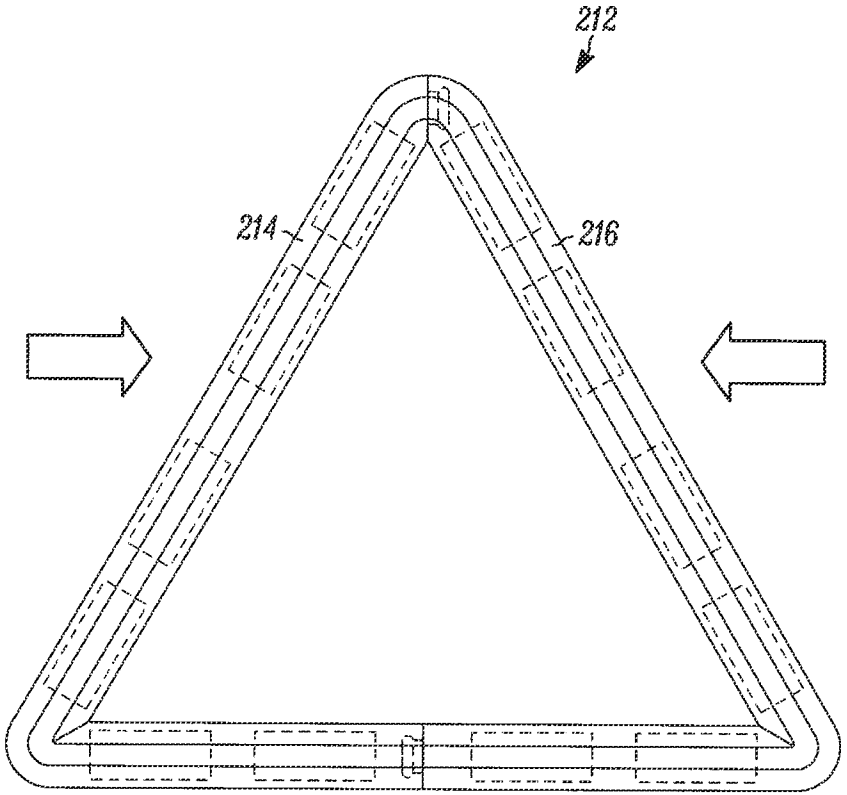
Figure 15:
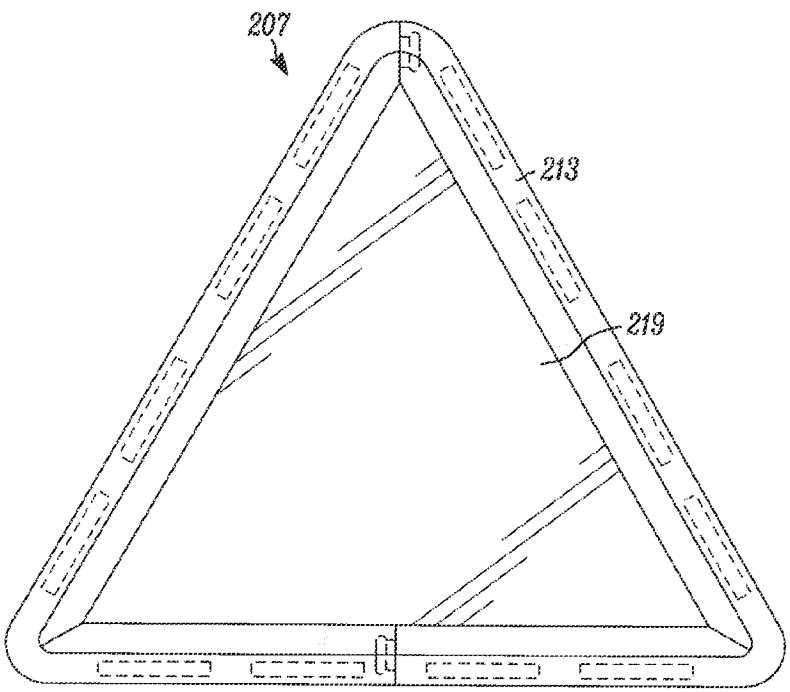
FIG. 15 is a front view of another magnetic building tile with a panel that exposes the frame from the front view.
Figure 14:
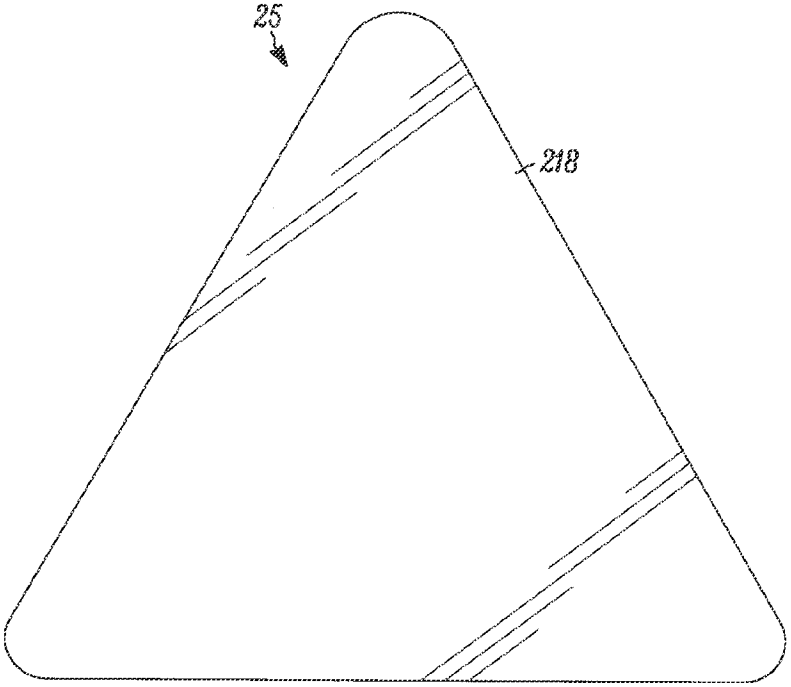
FIG. 14 is a front view of the magnetic building tile of FIGS. 12-13 with a panel that covers the frame from the front view.

FIGS. 12 and 13 illustrate one exemplary embodiment of a triangular frame element 212 with a first frame portion 214 and a second frame portion 216 that may connect via connection mechanism 222 that is similar to those discussed above. FIGS. 14 and 15 illustrate two formed building tiles 25, 207. Triangular building tile 25 has a panel 218 with a channel into which the tile frame extends. Triangular building panel 207 has a triangular tile frame 213 that has a channel into which the panel 219 extends.

The building tiles described herein can be manipulated and configured in a number of ways. For example, as discussed above, the edges and faces of the tile adjacent the edges may be magnetically connected together. Further, the building tiles may be connected to other structures, such as a cardboard box or cardboard piece. In addition to using the building tiles discussed above, connectors, such as a magnetic connector and/or mechanical connector may be employed to secure the building tiles to other structures or pieces.

Figure 16:
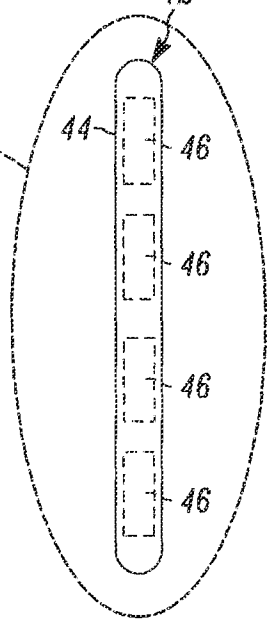
FIG. 16 is a front view of a magnetic connector.
Figure 17:
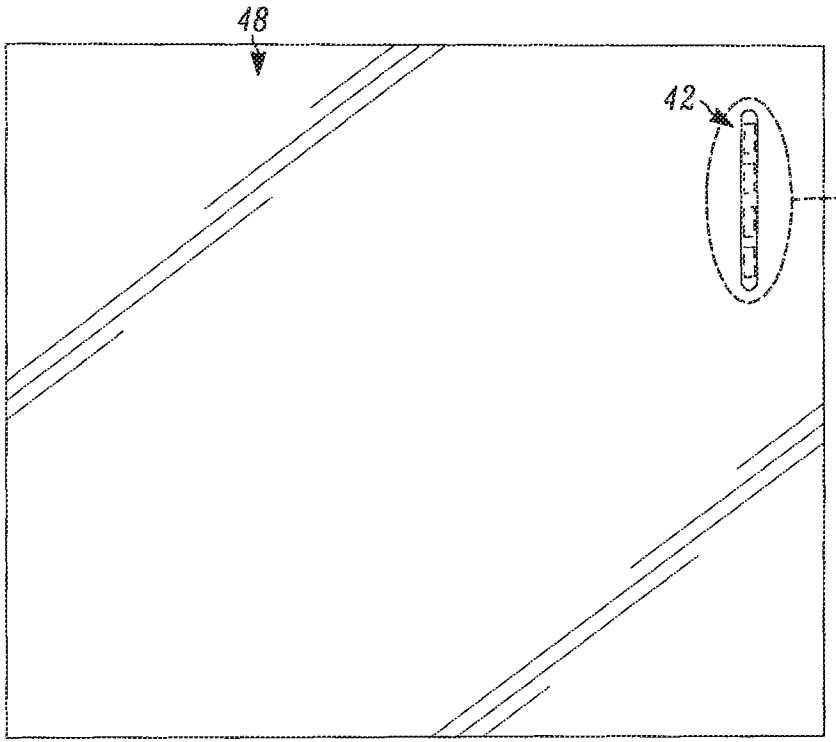
FIGS. 17-19 are front views illustrating the magnetic connector of FIG. 16 being connected with the magnetic building tile of FIG. 1.

As shown in FIGS. 16 and 17, the magnetic connector element 42 (hereinafter referred to as the "magnetic connector") may include a frame element 44 and magnets 46 disposed therein. The magnets 46 may be disposed within the frame 44 in any of the manners discussed above. In one approach, the frame element 44 is a single, linear frame element having at least one surface that is generally flat and that can be disposed flush against a flat surface. As shown in FIG. 17, the magnetic connector 42 may be disposed on the inside surface of a cardboard piece 48. In this manner, magnetic building tiles 10, 100, or any other shape/configuration of magnetic tile or other connectors, including those described below, may be attached to the cardboard piece 48 by placing one or more magnetic connector 42 on the inside surface and another magnetic element (i.e., building tiles or connectors) adjacent the internal magnetic connector 42, but on the outside surface of the cardboard piece 48.

Figure 20:
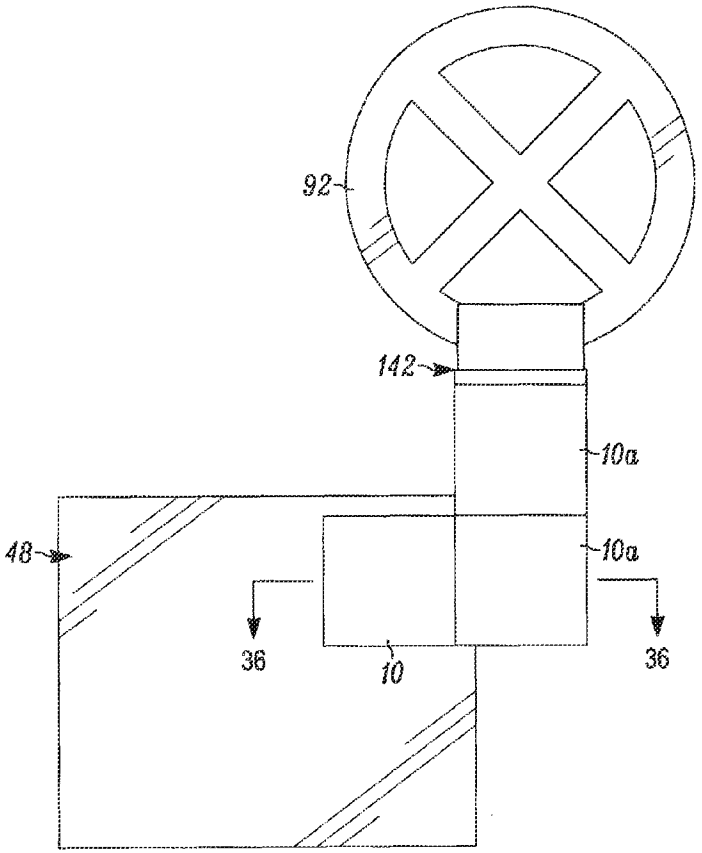
FIG. 20 is a front view illustrating a plurality of magnetic building tiles connected together.
Figure 18:
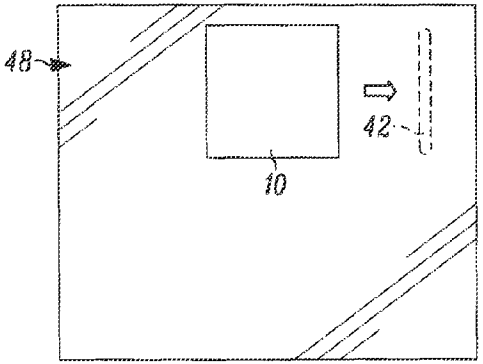
Figure 19:
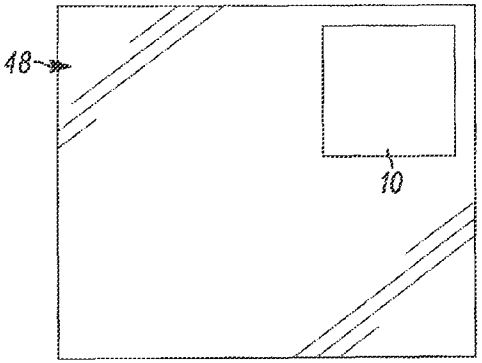
Figure 21:
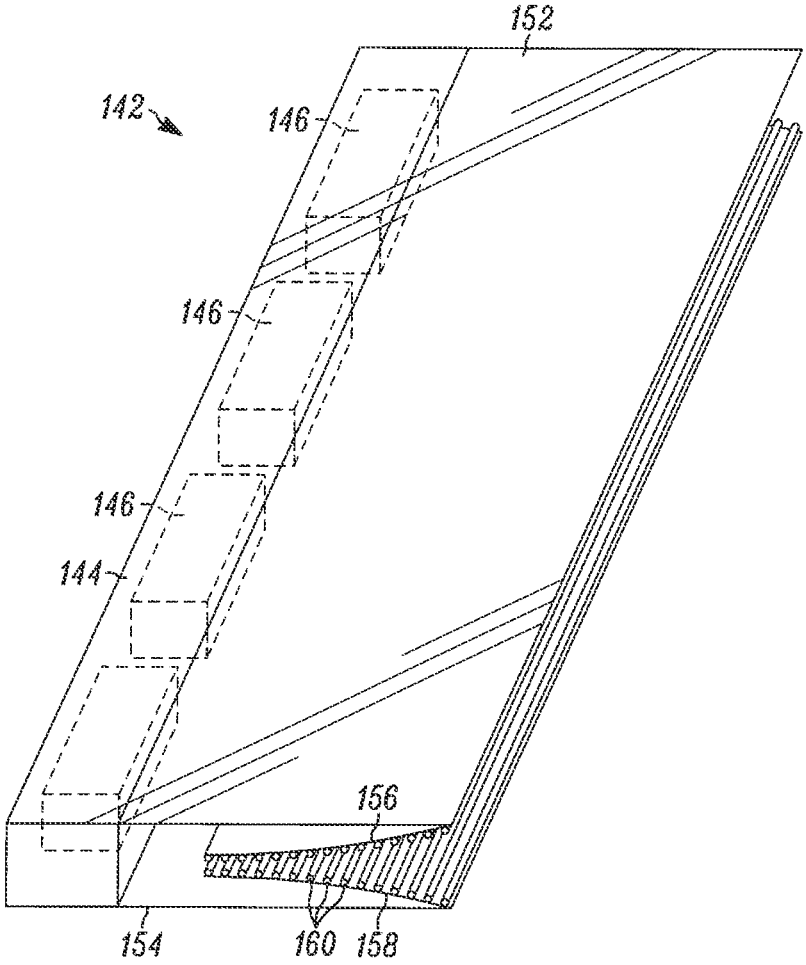
FIG. 21 is a perspective view of a mechanical connector in accordance with another embodiment.
Figure 22:
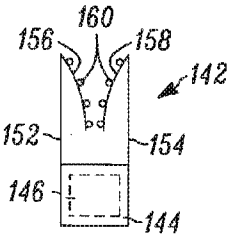
FIGS. 22-25 are top, front and side views of the mechanical connector of FIG. 21.

FIGS. 18-20 depict magnetic building tiles 10, 10*a* being attached to the cardboard piece 48. As shown in FIGS. 16 and 17, the magnetic connector 42 may be disposed on an inside surface of the cardboard piece 48 near an upper corner thereof. A magnetic building tile 10 is then advanced to a position on the outside of the cardboard piece 48 that is adjacent the magnetic connector 42, but on the opposing surface of the wall of the cardboard piece 48. Depending on the materials of the building tiles 10, more than one magnetic connector 42 may be disposed on the inside surface of the cardboard piece 48 to secure the building tile 10 to the outside surface of the box. For example, two, three, or even four magnetic connectors 42 may be disposed on the inside surface of the cardboard piece 48 in an arrangement that corresponds to the first and second frame portions 14, 16 of the building tile 10. See, e.g., FIGS. 36-38 illustrating two magnetic connectors 42 disposed on the inside surface of the cardboard piece 48 to provide additional stability for the building tile 10. Other magnetic elements also may be disposed on the inside surface of the cardboard piece 48, i.e., another magnetic tile or another connector, such as those described below.

Once the magnetic building tile 10 is in position on the outside of the cardboard piece 48, such that it remains attached to the cardboard piece 48 via the magnetic connection, additional magnetic building tiles 10*a* may be attached to the first magnetic building tile 10. In this manner, cardboard, including a typical cardboard box, may be used with building tiles and connectors described herein. In addition, building tiles 10, 10*a* and magnetic connectors 42 may be connected to another connector, such as mechanical connector 142 that has a pair of wings, as described below. In the example of FIG. 20, the mechanical connector 142 attaches a cutout 92. Though the cutout 92 is illustrated as a railroad crossing sign, numerous alternative cutouts may engage with mechanical connectors 142.

FIGS. 21-25 illustrate another exemplary magnetic and mechanical connector 142. The mechanical connector 142 has a frame element 144 with magnets 146 disposed therein. The magnets 146 may be disposed within the frame 144 in any of the manners discussed above. The mechanical connector 142 has a pair of extension elements 152, 154 that are attached to and extend from the frame 144 in a substantially parallel arrangement. As shown, each of the extension elements 152, 154 has a connector wing 156, 158 flexibly connected to the extension element 152, 154. In one approach, the end of the connector wing 156, 158 is attached to an end of the extension element 152, 154 disposed a distance from the frame element 144. Further, the flexibly connected wings 156, 158 extend between the parallel extension elements 152, 154, and a plurality of friction elements 160 may be disposed on the pair of flexibly connected wings 156, 158 on a surface thereof that faces the other of the connector wings 156, 158.

Figure 30:
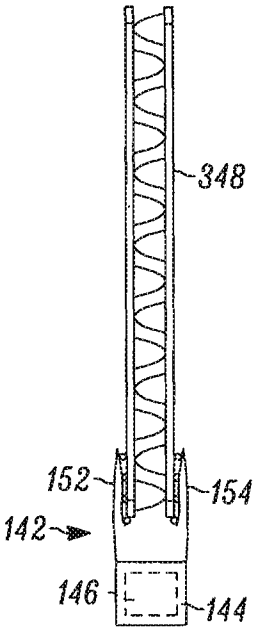
FIGS. 29 and 30 are top views illustrating the mechanical connector of FIG. 21 attaching to a cardboard cutout.

In this manner, a sheet, such as a cardboard panel (or panel made of another material), may extend between the connector wings 156, 158 and engage the friction elements 160 disposed therein (see, e.g., FIG. 30). This permits the mechanical connector 142 to attach magnets, such as magnets 146, to a cardboard (or other) piece or a cardboard box such that the building tiles, or other connectors, can thereafter be attached to such piece or box.

Figure 26:
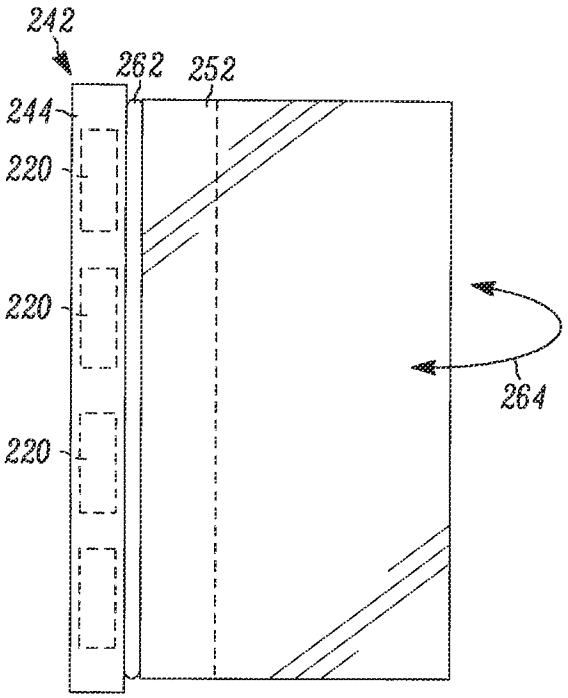

Another exemplary magnetic, mechanical connector 242 is shown in FIG. 26. The mechanical connector 242 includes a frame 244 with parallel extension elements 252 connected thereto. The mechanical connector 242 also includes wings and friction elements similar to those discussed above with respect to mechanical connector 142. Further, the mechanical connector 242 includes a hinge 262 that permits the extension elements 252 to move or rotate relative to the frame element 244 and the magnets 220. Also, when a cardboard piece or box, or other panel type, is disposed within the extension elements 252 of the mechanical connector 242, the cardboard piece or box, or other panel type, may move relative to the frame element 244 and any magnetic building tiles or connectors attached thereto. In short, arrow 264 depicts the movement of the parallel extension elements 252 relative to the frame 244.

Figure 24:
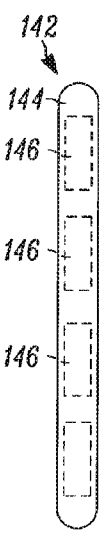
Figure 25:
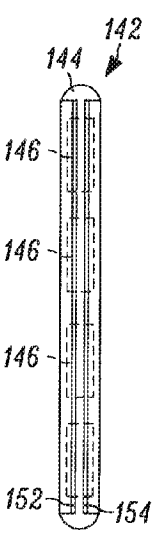
Figure 23:
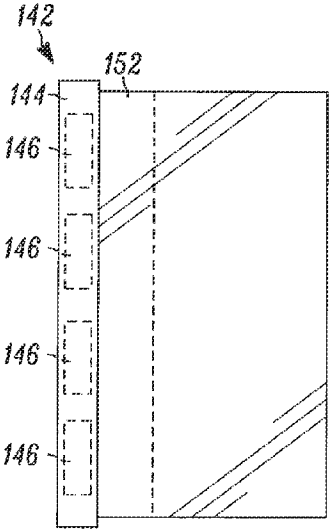
Figure 27:
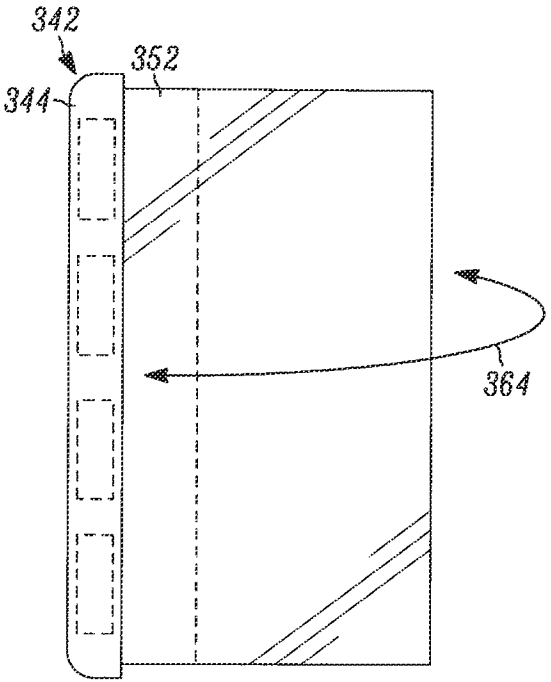
FIGS. 26 and 27 illustrate mechanical connectors in accordance with further embodiments.

FIG. 27 depicts another magnetic, mechanical connector 342, which is similar to mechanical connector 242, but lacks a hinge element. The mechanical connector 342, instead, has a frame 344 with a rounded configuration about its face disposed away from the side of the mechanical connector 342 with the parallel extension elements 352 extending therefrom. Previous connectors had rounded ends as shown in FIGS. 24 and 25 (though squared edges also may be incorporated) and at least a partially flat face, whereas mechanical connector 342 also has a rounded face and also has a cross section of the frame 344 that is similar to a semi-circle. In this manner, the mechanical connector 342 may rotate around the side of the frame 344 disposed away from the extension elements 352. As shown in FIG. 27 with arrow 364, this provides for a larger range of motion than that resulting from the hinge 262 of the mechanical connector 242 illustrated in FIG. 26. Thus, a building kit or system may include either or both of the mechanical connectors 242, 342 to permit the user to create structures with portions that rotate relative to one another. In addition, it is anticipated that a mechanical connector with both a hinge and a rounded configuration about its face may be employed.

Figure 28:
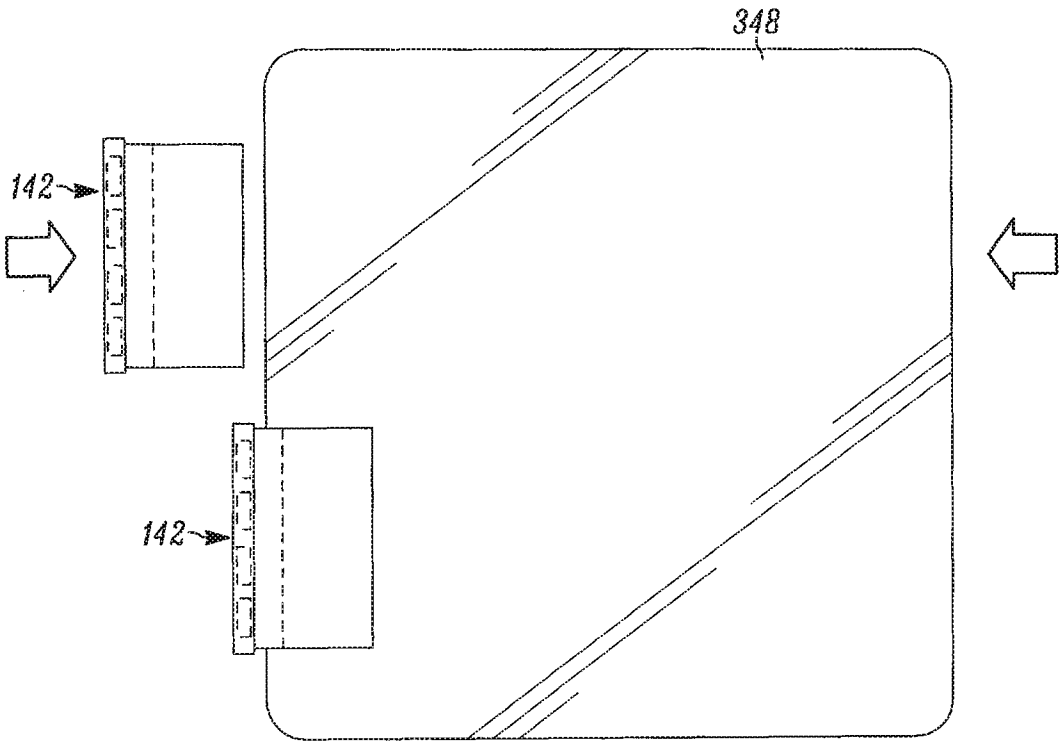
FIG. 28 is a front view illustrating the mechanical connectors of FIG. 21 attached to a cardboard cutout.

FIG. 28 depicts a large cardboard piece 348 with one mechanical connector 142 attached thereto and another mechanical connector 142 being pushed into engagement with the cardboard piece 348. Once the mechanical connectors 142 are attached to the cardboard piece 348, additional building tiles or connectors can be joined thereto. Further, the piece could be any of a variety of shapes, sizes, designs, or materials. If the cardboard piece 348 is to operate as a door, or other rotating element, of a structure, the mechanical connectors 142 may be exchanged for other mechanical connectors such as connectors 242 or 342.

Figure 29:
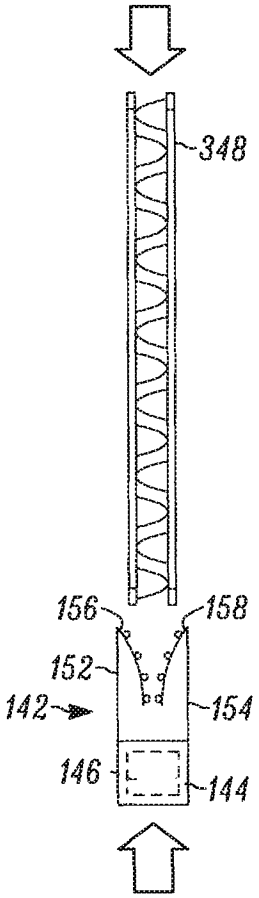

FIG. 29 illustrates the cardboard piece 348 as it is being pushed into contact with the mechanical connector 142. Once the cardboard piece 348 is in position between the extension elements 152, 154 and their respective flexible wings 156, 158, the friction elements 160 disposed on the wings 156, 158 will secure the cardboard piece 348 to the mechanical connector 142 by the friction generated between the wings 156, 158 and the cardboard piece 348. In this manner, the mechanical connector 142 is secured to the cardboard piece 348 by friction and additional magnetic tiles or connectors can be attached to the mechanical connector 142 via magnetism. The mechanical connector 142 and cardboard piece may be separated by pulling the cardboard piece out of the connector with sufficient force to overcome the friction.

As mentioned above, a building set or kit 50 may be comprised of a number of different magnetic building tiles and/or connectors. The building set 50, shown in FIG. 31, may include a number of building tiles, e.g., 10, 13, 25, that have a frame disposed in the channel of the panel and/or building tiles, e.g., 100, 207, that have a frame disposed around and outward of the edges of the panel. Whether a channel is disposed on the frame or the panel, the building tiles are all magnetically connectable to one another along their edges and faces. In addition, the building tiles can be magnetically connected to connectors, for example, as shown in FIG. 31. In addition, two mechanical connectors 142, 242, or 342, may be magnetically connected to one another such that two cardboard pieces 348 and 349 may be secured adjacent to one another.

Additional illustrative building kits 70, 80 are illustrated in FIGS. 32 and 33, and these kits also may include a number of magnetic tiles, connectors, and panel pieces, which may be arranged to form a variety of structures, such as a fort or vehicle. With a variety of building elements, a user can assemble or arrange the elements in a myriad of different configurations. For example, the structure created with the kit 70 shown in FIG. 32 employs a variety of building tiles 10, 25, and a variety of mechanical connectors 142, 242. In addition, a number of differently shaped panel pieces 448, 449, 450, which may be comprised of cardboard, may interface with the mechanical connectors and building tiles. FIG. 33 illustrates a kit 80 used to create a structure with a variety of building tiles including square building tiles 10, 100, rectangular building tiles 13, 113, and triangular building tiles 25, 125. In the illustrative structure of FIG. 33, pieces 548, 590 have been incorporated into the structure with mechanical connectors 142.

Figure 34A:
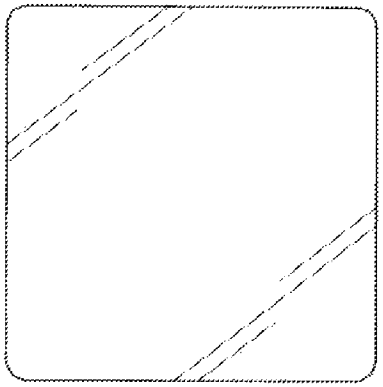
FIGS. 34A-34G are front views illustrating various embodiments of panels.
Figure 34B:
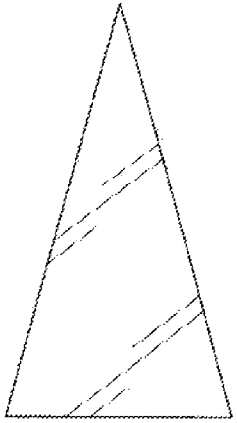
Figure 34C:
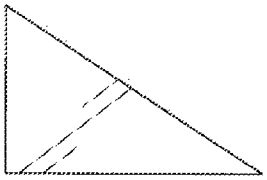
Figure 34D:
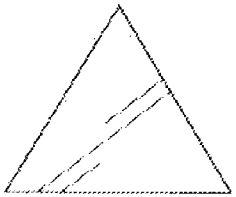
Figure 34E:
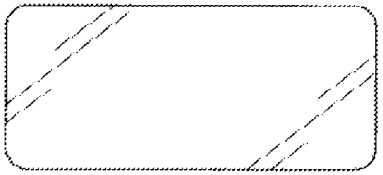
Figure 34F:
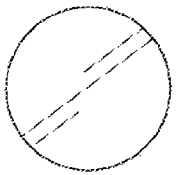
Figure 34G:
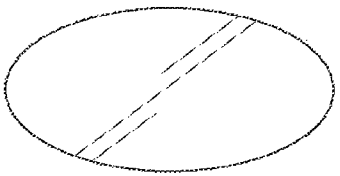

To provide the user with a variety of building tiles usable to create different structures, the kits may include panels and frames of different shapes. FIGS. 34A-34G illustrate a few of the numerous options for the panel shape. FIG. 34A illustrates a square panel and FIGS. 34B-D illustrate different triangular panels. FIG. 34E illustrates a rectangular panel and FIG. 34F illustrates a circular panel. FIG. 34G illustrates an oval panel. These panels are illustrated for exemplary purposes and different panel shapes are anticipated. Further, these panels can be incorporated into any of the tile or frame configurations discussed above, i.e., a panel with a channel or a frame with a channel.

Figure 35C:
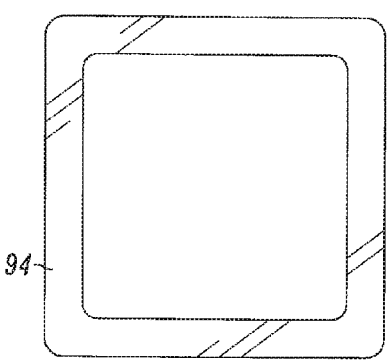
FIGS. 35A-35E are front views illustrating various embodiments of cardboard cutouts.
Figure 35B:
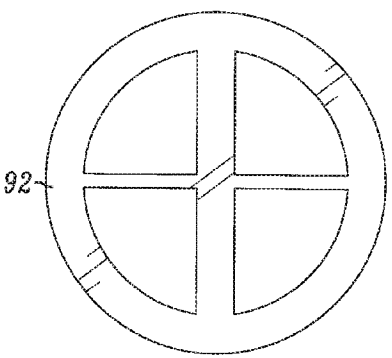
Figure 35A:
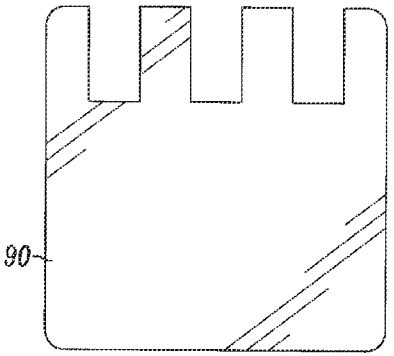
Figure 35E:
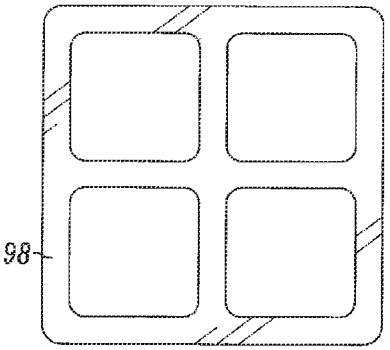
Figure 35D:
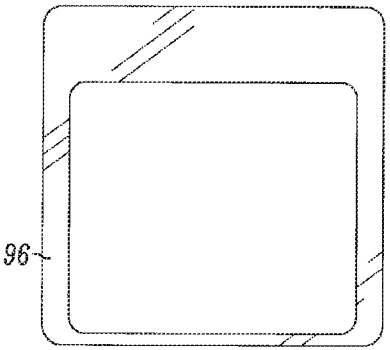

A kit also may include a plurality of panel pieces, such as cardboard cutouts, that may be assembled together with one another and with tiles, such as with the use of the mechanical connectors 142, 242, 342. By one approach, these cardboards pieces may be formed from a sheet of cardboard having lines of weakness formed therein, wherein the lines of weakness create a plurality of discrete tiles resembling building elements. Once separated from the sheet of cardboard these discrete cardboard pieces may be secured to one another to form a variety of structures. These cardboard pieces may have a variety of details that correspond to known architectural features. For example, FIG. 35A shows a cutout piece 90 having a notched configuration that could be used to depict portions of a castle or an element of a car, or various other elements of a structure. Panel or cutout pieces 92, 94, 96, 98 of FIGS. 35B-E depict various window configurations, though these may be repurposed into many alternative elements. Indeed, cutout piece 92 was rotated in FIG. 20 to depict a railroad crossing sign. These pieces may include a plastic portion in the center of the open portion, or may not have any material disposed in the openings. These configurations are not an exhaustive representation, but are merely examples of the various optional pieces that may be used herewith. Also, some of these cutout pieces may be formed into magnetic tiles with a corresponding frame. For example, the cutout 90 may be engaged with a frame such as tile frame 112 to create a magnetic tile having openings therein.

A wide variety of modifications, alterations, and combinations can be made with respect to the above described embodiments without departing from the scope of the invention, and are within the ambit of the inventive concept. For example, there are numerous variations on the size and shape of the building tiles disclosed herein.

What is claimed:

1. A magnetic connector for building elements comprising:

a frame element with magnets embedded therein, the magnets disposed in an arrangement permitting the frame element to magnetically connect with another frame element;

a first and a second extension element, the extension elements extending from the frame element in a substantially parallel arrangement;

a first wing and a second wing, the first wing flexibly connected to the first extension element and the second wing flexibly connected to the second extension element, the first and second wings arranged on inside surfaces of the first and second extension elements, the first and second wings extending from distal portions of the first and second extension elements toward the frame element; and each of the first and second wings having a friction element incorporated therein and configured to engage and securely attach the magnetic connector to a sheet of material, the wings being flexible and outwardly compressible to accommodate sheets of different thicknesses.

2. The connector of claim 1 wherein the sheet of material is one of the following: a cardboard cutout, paperboard cutout, plastic cutout, or composite material cutout.

3. The connector of claim 1 further comprising a hinge that permits the pair of extension elements to move relative to the frame element.

4. The connector of claim 3 wherein the hinge is disposed between the pair of extension elements and the frame element.

5. The connector of claim 1 wherein the frame element further comprises a rounded surface disposed opposite the pair of extension elements such that the magnetic connector may move about a side of the magnetic connector opposite the pair of extension elements.

6. The connector of claim 1 further comprising a hinge that permits the pair of extension elements to move relative to the frame element and wherein the frame element further comprises a rounded configuration disposed opposite the pair of extension elements.

7. The connector of claim 1 wherein the frame element is injection molded and the magnets are secured therein.

8. A magnetic connector for building elements comprising:

a frame element with magnets embedded therein, the magnets disposed in an arrangement permitting the frame element to magnetically connect with another frame element;

a first and a second extension element extending from the frame element in a substantially parallel arrangement;

a first and a second wing, the first wing resiliently mounted to the first extension element and the second wing resiliently mounted to the second extension element, the first and second wings extending from distal portions of the first and second extension elements toward the frame element; and each of the first and second wings having frictional elements disposed thereon;

the magnetic connector being capable of attachment by friction to a sheet of material pushed in between the extension elements, wherein the sheet of material can be separated from the magnetic connector by pulling the sheet of material out of the connector, the wings being flexible and outwardly compressible to accommodate sheets of different thicknesses.

9. The connector of claim 8 wherein the sheet of material is one of the following: a cardboard cutout, paperboard cutout, plastic cutout, or composite material cutout.

10. The connector of claim 8 further comprising a hinge that permits the pair of extension elements to move relative to the frame element.

11. The connector of claim 10 wherein the hinge is disposed between the pair of extension elements and the frame.

12. The connector of claim 8 wherein the frame element further comprises a rounded surface disposed opposite the pair of extension elements such that the magnetic connector may move about a side of the magnetic connector opposite the pair of extension elements.

13. The connector of claim 8 further comprising a hinge that permits the pair of extension elements to move relative to the frame element and wherein the frame element further comprises a rounded configuration disposed opposite the pair of extension elements.

14. The connector of claim 8 wherein the frame element is injection molded and the magnets are secured therein.

* * * * *